US006948189B2

(12) United States Patent
Early

(10) Patent No.: US 6,948,189 B2
(45) Date of Patent: Sep. 27, 2005

(54) VENTABLE SKI HAT AND METHOD OF MANUFACTURE THEREOF

(76) Inventor: Christopher A Early, 1 Rochester Ct., Algonquin, IL (US) 60102

( * ) Notice: Subject to any disclaimer, the term of this patent is extended or adjusted under 35 U.S.C. 154(b) by 236 days.

(21) Appl. No.: 10/422,382

(22) Filed: Apr. 24, 2003

(65) Prior Publication Data

US 2004/0210983 A1 Oct. 28, 2004

(51) Int. Cl.[7] ..... A42C 5/04
(52) U.S. Cl. ..... 2/184.5; 2/209.5
(58) Field of Search ..... 2/171.4–171.8, 2/182.3, 209.11, 209.3, 209.5

(56) References Cited

U.S. PATENT DOCUMENTS

| | | | | | |
|---|---|---|---|---|---|
| 1,039,605 | A | * | 9/1912 | Smith et al. | 2/182.5 |
| 1,105,400 | A | * | 7/1914 | Burke | 2/171.5 |
| 1,609,678 | A | | 12/1926 | Wasserstrom | |
| 1,625,670 | A | | 4/1927 | Maxwell | |
| 1,682,004 | A | | 8/1928 | Cremen | |
| 1,684,670 | A | | 9/1928 | Habib | |
| 1,869,652 | A | * | 8/1932 | Baker | 2/171.5 |
| 1,990,096 | A | | 2/1935 | Rothchild | |
| 1,997,678 | A | | 4/1935 | Cremen | |
| 2,051,084 | A | | 8/1936 | Hertz | |
| 2,111,444 | A | | 3/1938 | Bauer | |
| 2,349,471 | A | * | 5/1944 | Starbeck | 2/171.5 |
| 2,629,103 | A | | 2/1953 | Berg | |
| 4,101,981 | A | | 7/1978 | Boden | |
| 4,550,445 | A | | 11/1985 | Fender | |
| 4,989,270 | A | | 2/1991 | Boughten | |
| 5,337,421 | A | | 8/1994 | Jeng | |
| 5,495,622 | A | * | 3/1996 | Kaufman | 2/175.1 |
| 5,642,526 | A | | 7/1997 | Thompson | |
| 5,822,800 | A | | 10/1998 | Anderson | |
| 5,839,121 | A | | 11/1998 | Morales | |
| 5,855,023 | A | | 1/1999 | Clingenpeel | |
| 5,862,523 | A | | 1/1999 | Proctor | |
| 6,243,876 | B1 | | 6/2001 | Provenzano | |

OTHER PUBLICATIONS

Mental Headgear Web–Site www.mentalgear.com/f3798_op_ventilator.asp "Optic Port Ventilator" web–page print-out attached herewith.

* cited by examiner

*Primary Examiner*—Katherine M. Moran
(74) *Attorney, Agent, or Firm*—Meroni + Meroni, P.C.; Christopher J. Scott; Charles F. Meroni, Jr.

(57) ABSTRACT

The present invention provides a ventable ski hat for enabling a skier to selectively vent body heat, the ventable ski hat essentially comprising a superficial insulative fabric layer, a deep moisture-wicking fabric layer, zipper structure, a mesh fabric layer, and an insulative head band member. Together the superficial fabric layer and the deep fabric layer define a superior vent portion and an inferior crown-receiving portion. The superior vent portion comprises an anterior-superior portion, a posterior-superior portion and a selectively-ventable vent aperture. The zipper structure is located at the vent aperture for selectively venting the vent aperture. The zipper structure is medially aligned along a wearer's head in superior adjacency to the wearer's superior head surface, thus defining an insulative air layer. The zipper structure thus enables the wearer to selectively vent body heat from the insulative air layer.

46 Claims, 4 Drawing Sheets

VENTABLE SKI HAT AND METHOD OF MANUFACTURE THEREOF

BACKGROUND OF THE INVENTION

1. Field of the Invention

The present invention generally relates to a cold weather hat for use during winter sporting activities. More particularly, the present invention relates to a thermally insulative hat, which may be selectively vented during winter sporting activities to more readily exhaust heat to the surrounding atmosphere via convective currents. The present invention thus provides users with a means to prevent bodily discomfort or overheating during rigorous winter sporting activities.

2. Description of the Prior Art

Key to success in any winter sporting activity is the requirement to dress warmly. It is noted that the human body ordinarily remains at a fairly constant temperature of 37° Celcius (98.6° Fahrenheit). It is very important that this body temperature be maintained and, since there is a continuous body heat gain from internal body processes, there must also be a continuous body heat loss to maintain body heat in balance. Excess heat must be absorbed by the surrounding air or lost by radiation. As the temperature and humidity of the environment in which a human body is active varies, the human body automatically regulates the amount of heat it gives off. However, the human body's ability to adjust to varying environmental conditions is limited. Furthermore, although the body may adjust to a certain (limited) range of atmospheric conditions, it does so with a distinct feeling of discomfort. The following is a brief discussion of how atmospheric conditions affect the body's ability to maintain a heat balance and the background information supporting the development of the present invention.

The human body gains and loses heat by radiation, convection, conduction, evaporation, and as a by-product of other physiological processes that take place within the body, namely the oxidation of food, other chemical processes, and by friction and tension within muscle tissues. Most body heat, however, is produced by the foods consumed by the individual, which body heat must be removed continuously or body temperature would steadily rise. The principal routes of body heat loss include radiation, conduction, convection, and evaporation. Radiation is the transfer of heat as infrared heat rays from a warmer object to a cooler object without physical contact. The human body loses heat by the radiation of heat waves to cooler objects nearby such as ceilings, floors and walls. If these objects are at a higher temperature, the human body absorbs heat by radiation. Incidentally, air temperature has no relationship to the radiation of heat to and from objects. Skiers, for example, are, on occasion, able to comfortably remove clothing in bright sunshine even though the air temperature is very low because the radiant heat from the sun is adequate to warm the skier. In a room at 21° C. (70° F.), about 60 percent of heat loss is by radiation in a resting person.

Conduction is the process by which body heat is transferred to a substance or object in contact with the body, such as chairs, clothing, jewelry, air or water. At rest, about 3 percent of body heat is lost via conduction to solid objects. The contact of air or water with the human body results in heat transfer by both conduction and convection. Convection is the transfer of heat by the movement of a liquid or gas between areas of different temperature. When cool air makes contact with the body, it becomes warmed and less dense. The less dense air then rises. Subsequently, cool air makes contact with the body and is carried away as it warms by conduction and becomes less dense. The faster the air moves, the faster the rate of convection. When at rest, about 15 percent of body heat is lost to the air by conduction and convention.

Evaporation is the conversion of a liquid to vapor. Water has a high heat of evaporation, and because of this characteristic, every gram of water (as found in perspiration) evaporating from the skin takes with it a relatively great deal of heat—on the order of about 0.58 kilocalories per gram of water. Under normal conditions, about 22 percent of heat loss occurs through evaporation. Under extreme conditions, about 4 liters of perspiration are produced each hour, and this volume can remove about 2,000 kilocalories of heat from the body. This is approximately 32 times the basal level of heat production.

Even though there are wide fluctuations in environmental temperature, the human body's homeostatic mechanisms can maintain a normal range for the internal body temperature. If the body heat production equals the body heat loss, the body maintains a constant core temperature near the earlier cited 37° C. Body heat losses may be classified in two general categories, namely, loss of sensible heat and loss of latent heat. Sensible heat is given off by radiation, convection and conduction. Latent heat is given off in the breath and by evaporation or perspiration. In perfectly still air, the layer of air around a body absorbs the sensible heat given off by the body and increases in temperature. The layer of air also absorbs some of the water vapor given off by the body, thus increasing the relative humidity. This means the body is surrounded by an envelope of moist air that is at a higher temperature and relative humidity than the ambient air. Therefore, the amount of heat the body can lose to this envelope is less than the amount it can lose to the ambient air. When the air is set in motion past the body, the envelope is continually being removed and replaced by the ambient air, thereby increasing the rate of heat loss from the body. When the increased heat loss improves the body heat balance, the sensation of a breeze is felt; when the increase is excessive, the rate of heat loss makes the body feel cool and the sensation of a draft is felt.

From the foregoing discussion, it is evident that the three factors, namely temperature, humidity, and air motion, are closely interrelated in their effects upon the comfort and health of winter sports enthusiasts. In fact, a given combination of temperature, humidity, and air motion will produce the same feeling of warmth of coolness as a higher or lower temperature in conjunction with a compensating humidity and air motion. The term given to the net effect of these three factors is known as the Effective Temperature. Effective Temperature cannot be measured by an instrument, but can be found on a special psychometric chart when the temperatures and air velocity are known. The combinations of temperature, relative humidity, and air motion of a particular Effective Temperature may produce the same feeling of warmth of coolness. However, they are not all equally comfortable. Relative humidity below about 15 percent produces a parched condition of the mucous membranes of the mouth, nose and lungs, and increases susceptibility to disease germs. Relative humidity above about 70 percent causes an accumulation of moisture in the clothing. For the best health conditions, relative humidity ranges from about 40 to 50 percent for cold weather and from 50 to 60 percent for warm weather.

As earlier stated, most of the body heat produced by the human body comes from oxidation of the food humans eat.

The rate at which this heat is produced is referred to as the metabolic rate. Among the factors that affect the metabolic rate are the following: exercise, nervous system, hormones, body temperature, food ingestion, age and several other variables of lesser direct involvement, namely gender, climate, sleep, and malnutrition. During strenuous exercise activity, such as skiing or snowboarding, the metabolic rate may increase to as much as 15 times the normal rate; in well-trained athletes, the rate may increase to a rate 20 times the normal metabolic rate.

In this regard, adequate clothing protection for the winter sports enthusiast is essential. Adequate clothing protection should not only include means for retaining body heat in adjacency to the skin of the athlete, but also means for selectively releasing or venting body heat from areas in adjacency to the skin to help maintain a more agreeable body heat level. Without a means to release or vent body heat, it is noted that skiers often experience a great increase in body heat, which generally causes discomfort during those intervals between strenuous activities, which intervals are marked by relatively little bodily activity. Typically, the intervals of little bodily activity occur during ski lift or tow periods to the start of a ski run and the like. For example, after a strenuous downhill run, the body heat increases dramatically, but downhill motion causes air movement over the body, thus causing the removal of excess heat from the body. The period of strenuous exercise is countered with air motion and thus creates a sense of body heat balance. However, after the downhill run is complete and the skier becomes sedentary on a ski lift, the body heat is still at a high level, causing the body to perspire and overheat. During this period goggles may fog up as heat leaves the facial area exposed beneath an insulative hat and perspiration may build up on the superficial head surfaces, both of which events may cause bodily discomfort during the described period of inactivity.

It is estimated that as much as 50 to 80 percent of body heat is lost through the head of a strenuously exercising human body. In this regard, adequate head wear protection is essential for both retaining and venting body heat as may be required. It is noted that different types of head wear with vents have been developed in an attempt to aid users in the pursuit of maintaining a more leveled body heat balance. It is further noted that the prior art teaches a great variety of head wear or hats with air vents. Some of the more pertinent prior art relating to head wear incorporating venting systems and the like is described hereinafter.

U.S. Pat. No. 1,990,096 ('096 patent), which issued to Rothchild, discloses a Ventilated Hat. The '096 patent teaches a hat with ventilation means preferably enabled through the use of slide fastener or zipper means. Rothchild thus essentially claims a hat having a crown to cover the head of the wearer, which crown comprises at least one slit for communicating with the outer atmosphere. One end of the slit is disposed at a point adjacent the top of the crown and the other end of the slit terminates at a point adjacent the base of the crown. The slide fastener means are adapted to close the slit in selective degrees as desired by the user.

U.S. Pat. No. 2,051,084 ('084 patent), which issued to Patton, discloses an Adjustable Cap. The '084 patent teaches a cap comprising two similar substantially rectangular plies of fabric superimposed one on the other, which together constitute the crown and head band. The plies are joined together along one longitudinal edge and a short edge, thereby leaving the plies unjoined at the other longitudinal edge and at least partly along the last named short edge. An outward projection extends from each of the plies at the unjoined portion at the short edge thereof. The projections are adapted to overlap each other and form the cap to the head of the wearer. Further, adjustable fastening means are located along the unjoined longitudinal edges of the plies at the projections. A continuous cuff is secured to the unjoined longitudinal edges of the plies and is coextensive with the projections. The cuff comprises sufficient width so as to overlap the projections when turned upward.

U.S. Pat. No. 2,349,471 ('471 patent), which issued to Starbeck, discloses Headgear. The '471 patent teaches a ventilated head covering or headgear which comprises a plurality of similarly contoured pieces secured together. Certain of the similarly contoured pieces are selectively detached one from the other to provide flaps, which flaps are foldable back upon themselves to form openings in the crown. Mesh-like materials span the resultant openings and slide fasteners coact with the flaps and other pieces in the crown for fastening the flaps to the crown and close the openings.

U.S. Pat. No. 5,495,622 ('622 patent), which issued to Kaufman, discloses a Ventilated Hat. The '622 patent teaches an all weather runner's hat, the design of which promotes airflow around the head and hair of a person while, at the same time, deflecting rain. The Ventilated Hat comprises a generally hemispherical shell; a brim which is attached to the shell at an angle of about 15 degrees from horizontal and varies in width around the circumference; a number of vents positioned in the crown for ventilation; a headband; and a means of attaching the headband with spacers to create a novel air gap to allow air flow around the head and hair.

U.S. Pat. No. 5,642,526 ('526 patent), which issued to Thompson, discloses a Convertible Garment Having a Ventilation Opening and a Storage Pouch. The '526 patent teaches a garment wherein certain portions of the garment have ventilation openings incorporated into the design, which openings are preferably opened or closed via slidable fastening means or zipper means. A sublayer of fishnet-like mesh material is disposed at the opening for venting air from the garment to the outside atmosphere, which material may also be utilized to store the garment. In this regard, the garment may be condensed and stored in the mesh material which doubles as a storage pouch for the garment.

From a review of these patents and other prior art generally known in the relevant art, it will be seen that the prior art does not teach an insulative, ventable ski hat for enabling a skier to selectively vent body heat, which insulative ventable ski hat essentially comprises a superior vent portion and an inferior crown-receiving portion. It will be further seen that the prior art does not teach an insulative, ventable ski hat wherein the superior vent portion comprises an anterior-superior portion, a posterior-superior portion and a selectively-ventable vent aperture, the vent aperture being intermediate the anterior-superior portion and the posterior-superior portion. It will be further seen that the prior art does not teach an insulative, ventable ski hat wherein the vent aperture comprises open-closure means for selectively venting the vent aperture, the vent aperture being substantially elliptical in configuration. It will be further seen that the prior art does not teach an insulative, ventable ski hat comprising an elliptical vent aperture, which elliptical vent aperture necessarily comprises a major axis and a minor axis. The prior art does not teach an insulative, ventable ski hat wherein the major axis of the elliptically shaped vent aperture is medially aligned along a skier's head. Given the fact that a skier's head necessarily comprises a superior head surface, it will be seen that the prior art does not teach an insulative, ventable ski hat wherein the open-closure means is in spaced relation in superior adjacency to the superior head surface thus defining an insulative air layer, the open-closure means thus enabling a user to selectively vent body heat from the insulative air layer.

It will be further seen that the prior art does not teach an insulative, ventable ski hat wherein the vent aperture comprises a mesh fabric layer in inferior adjacency to the open-closure means, which mesh fabric layer and open-closure means together form a selectively-ventable, mesh-filtered vent. It will be further seen that the prior art does not teach an insulative, ventable ski hat wherein the open-closure means is defined by a zipper, which zipper comprises a main axis that coincides with the major axis of the substantially elliptical vent aperture. It will be further seen that the prior art does not teach a ventable ski hat wherein the ventable ski hat comprises a superficial fabric layer and a deep fabric layer, the superficial fabric layer comprising an insulative fabric material and the deep fabric layer comprising a moisture-wicking fabric material. Still further, it will be seen that the prior art does not teach an insulative, ventable ski hat wherein the major axis of the substantially elliptical vent aperture has a measured dimension ranging from about 5 inches to 6 inches and wherein the minor axis has a maximum measured dimension of about 1.5 inches.

The prior art thus perceives a need for an insulative, ventable ski hat for enabling a skier to selectively retain or vent body heat during strenuous winter sporting activities, as needed or desired by the skier, which insulative ventable ski hat essentially comprises a superior vent portion and an inferior crown-receiving portion. In this regard, the prior art perceives a need for an insulative, ventable ski hat wherein the superior vent portion comprises an anterior-superior portion, a posterior-superior portion and a selectively-ventable vent aperture intermediate the anterior-superior portion and the posterior-superior portion. Further, the prior perceives a need for an insulative, ventable ski hat wherein the vent aperture comprises open-closure means for selectively venting the vent aperture, the vent aperture being substantially elliptical in configuration when in a fully open state and substantially linear when in a fully closed state. Still further, the prior art perceives a need for an insulative, ventable ski hat comprising an elliptical vent aperture, which elliptical vent aperture necessarily comprises a major axis and a minor axis, the major axis of the elliptically shaped vent aperture being designed for medial alignment along a skier's head from the anterior-superior portion to the posterior-superior portion. The prior art thus perceives a need for an insulative, ventable ski hat wherein the open-closure means is designed to be in spaced relation in superior adjacency to the superior head surface of a skier, thereby defining an insulative air layer and the open-closure means thus enabling a user to selectively retain or vent body heat from the insulative air layer.

The prior art further perceives a need for insulative, ventable ski hat wherein the vent aperture comprises a mesh fabric layer in inferior adjacency to the open-closure means, which mesh fabric layer and open-closure means together form a selectively-ventable, mesh-filtered vent. Still further, the prior art perceives a need for an insulative, ventable ski hat wherein the open-closure means is defined by a zipper, the zipper comprising a main axis that coincides with the major axis of the substantially elliptical vent aperture. The prior art perceives an additional need for a ventable ski hat wherein the ventable ski hat comprises a superficial fabric layer and a deep fabric layer, the superficial fabric layer comprising an insulative fabric for retaining body heat in adjacency to the superior head surface and the deep fabric layer comprising a moisture-wicking material for conveying perspiration or liquid away from head surfaces. Still further, the prior art perceives a need for an insulative, ventable ski hat wherein the major axis of the substantially elliptical vent aperture has a measured dimension ranging from about 5 inches to 6 inches and wherein the minor axis has a maximum measured dimension of about 1.5 inches.

SUMMARY OF THE INVENTION

Accordingly, it is an object of the present invention to provide a low cost, ventable ski hat easily manufactured from an insulative type fabric, such as fleece, for enabling a skier to selectively retain or vent body heat during strenuous winter sporting activities, as required by the skier. In this regard, it is an object of the invention to provide a ventable ski hat that essentially comprises a superior vent portion and an inferior crown-receiving portion. Specifically, it is an object of the present invention to provide an insulative, ventable ski hat wherein the superior vent portion comprises an anterior-superior portion, a posterior-superior portion and a selectively-ventable vent aperture intermediate the anterior-superior portion and the posterior-superior portion. It is a further object of the present invention to provide an insulative, ventable ski hat wherein the vent aperture comprises open-closure means for enabling the user to selectively vent the vent aperture. In this last regard, it is an object of the present invention to provide a ventable ski hat having a vent aperture that is substantially elliptical in configuration when in a fully open state and substantially linear when in a fully closed state. An additional object of the present invention is to provide a ventable ski hat having an elliptical vent aperture, which vent aperture necessarily comprises a major axis and a minor axis, the major axis of the elliptically shaped vent aperture being designed for medial alignment along a skier's head from the anterior-superior portion to the posterior-superior portion and having a measured dimension of about 5–6 inches. It is a further object of the present invention to provide an insulative, ventable ski hat wherein the open-closure means is designed to be in spaced relation in superior adjacency to the superior head surface of a skier when donned by a skier or user thereby defining an insulative air layer between the superior head surface and the open-closure means. It is thus an object of the present invention to provide a ventable ski hat wherein the open-closure means enables a user to selectively retain or vent body heat from the insulative air layer as required as a means to maintain body heat balance or decrease the discomfort level.

It is a further object of the present invention to provide an insulative, ventable ski hat wherein the vent aperture comprises a mesh fabric layer in inferior adjacency to the open-closure means, which mesh fabric layer and open-closure means together form a selectively-ventable, mesh-filtered vent as a means to prevent matter from entering the insulative air layer. Still further, it is an object of the present invention to provide an insulative, ventable ski hat wherein the open-closure means is defined by a zipper, the zipper comprising a main axis that coincides with the major axis of the substantially elliptical vent aperture. Further still, it is an object of the present invention to provide an insulative, ventable ski hat wherein the ventable ski hat comprises a superficial fabric layer and a deep fabric layer, the superficial fabric layer comprising an insulative fabric material for retaining body heat in adjacency to the superior head surface and the deep fabric layer comprising a moisture-wicking material for conveying perspiration or liquid away from head surfaces. Still further, it is an object of the present invention to provide an insulative, ventable ski hat wherein the major axis of the substantially elliptical vent aperture has a measured dimension ranging from about 5 inches to 6 inches and wherein the minor axis has a maximum measured dimension of about 1.5 inches so as to provide an aesthetically pleasing yet functional vent aperture. In this last regard, it is a further object of the present invention to provide a ventable ski hat constructed from color coordinated materials so as to increase the attractiveness or visual appeal of the hat.

To achieve these and other readily apparent objectives, the present invention provides a ventable ski hat for enabling a skier to selectively vent body heat, the ventable ski hat essentially comprising a superficial insulative fabric layer, a deep moisture-wicking fabric layer, zipper means, a mesh fabric layer, and an insulative head band member. The superficial insulative fabric layer, the deep moisture-wicking fabric layer, the zipper means, the mesh fabric layer and the insulative head band member each comprises coordinate coloration or are constructed from materials that are color coordinated to increase the visual appeal of the hat.

The superficial insulative fabric layer essentially comprises two lateral superficial edges, two lateral superior superficial regions, two intermediate superior superficial regions, two medial superior superficial regions, a superficial fold region, an inferior superficial region, and a superficial layer perimeter. The superficial fold region divides the superficial insulative fabric layer into substantially identical superficial lateral halves. Similarly, the deep moisture-wicking fabric layer essentially comprises two lateral deep edges, two lateral superior deep regions, two intermediate superior deep regions, two medial superior deep regions, a deep fold region, an inferior deep region, and a deep layer perimeter. The deep fold region divides the deep moisture-wicking fabric layer into substantially identical deep lateral halves.

The deep moisture-wicking fabric layer is positioned in adjacency to the superficial insulative fabric layer such that the deep layer perimeter substantially coincides with the superficial layer perimeter. The deep moisture-wicking fabric layer and the superficial insulative fabric layer are folded about the coinciding fold regions after which the regions are stitched together as summarized hereinafter. The medial superior superficial regions and the medial superior deep regions are stitched to one another in juxtaposed relation to form a closed superior-anterior seam; the lateral superior superficial regions and the lateral superior deep regions are stitched to one another in juxtaposed relation to form a closed superior-posterior seam; and the lateral superficial edges and the lateral deep edges are stitched to one another in juxtaposed relation to form a closed posterior seam.

The intermediate superior superficial regions and the intermediate superior deep regions thus define a substantially elliptical superior vent aperture, the superior vent aperture comprising a major axis, a minor axis, an anterior vent end and a posterior vent end. The vent aperture is designed to be medially aligned along the user's head from the superior-anterior seam to the superior-posterior seam and is preferably elliptical when in an open state. In this regard, the major axis has a measured dimension ranging from about 5 inches to about 6 inches and the minor axis has a maximum measured dimension of about 1.5 inches. The inferior superficial region and the inferior deep region together define a double layer band-receiving edge.

The zipper means essentially comprises an anterior zipper end, a posterior zipper end, laterally extending attachment fabric, and slidable fastener means. The laterally extending attachment fabric is stitched to the intermediate superior superficial regions and the intermediate superior deep regions such that the anterior zipper end is adjacent the anterior vent end and the posterior zipper end is adjacent the posterior vent end. The slidable fastener means are intermediate the laterally extending fabric medially aligned from the anterior vent end to the posterior vent end substantially parallel with the major axis and are designed to enable the user to selectively open and close the vent aperture as required.

The mesh fabric layer essentially comprises an anterior mesh end and a posterior mesh end and is stitched to the intermediate superior superficial regions in adjacency to the zipper means such that the anterior mesh end is adjacent the anterior vent end and the posterior mesh end is adjacent the posterior vent end. The mesh fabric layer and the zipper means thus cooperatively form a selectively ventable, mesh-filtered vent, the mesh-filtered vent being substantially elliptical when in a fully open state. Notably, the mesh fabric layer is sized and shaped to be substantially taut when the mesh-filtered vent is in a fully open state.

The insulative head band member essentially comprises a superior band attachment edge, an inferior crown-receiving edge, a band fold region, and two lateral band edges. The head band member is folded about the band fold region and the lateral band edges are stitched to one another to form a band seam and the superior band attachment edge is stitched to the band-receiving edge whereby the band seam is in inferior adjacency to the posterior seam. The inferior crown-receiving end is designed to receive a skier's head or other wearer's head, which head necessarily comprises a superior head surface. The mesh fabric layer and zipper means are situated or are in spaced relation in superior adjacency to the superior head surface so as to define an insulative air layer above the superior head surface. The slidable fastener means thus enable the skier or wearer donning the hat to selectively retain or vent body heat from the insulative air layer, as required.

Additionally, the present invention provides a method of manufacturing a ventable ski hat, the method of manufacture essentially comprising the steps of (1) providing a superficial insulative fabric layer, a deep moisture-wicking fabric layer, a mesh fabric layer, and zipper means, the zipper means essentially comprising laterally extending attachment fabric and slidable fastener means. Step No. Two (2) involves cutting a superficial insulative fabric layer pattern from the superficial insulative fabric layer, the superficial insulative fabric layer pattern comprising two lateral superficial edges, two lateral superior superficial regions, two intermediate superior superficial regions, two medial superior superficial regions, a superficial fold region, and an inferior superficial region, the superficial fold region dividing the superficial insulative fabric layer pattern into substantially identical superficial lateral halves. Step No. Three (3) involves cutting a deep moisture-wicking fabric layer pattern from the deep moisture-wicking fabric layer, the deep moisture-wicking fabric layer comprising two lateral deep edges, two lateral superior deep regions, two intermediate superior deep regions, two medial superior deep regions, a deep fold region, and an inferior deep region, the deep fold region dividing the deep moisture-wicking fabric layer pattern into substantially identical deep lateral halves.

Step No. Four (4) involves cutting a head band member pattern from the superficial insulative fabric layer, the insulative head band member pattern comprising a superior band attachment edge, an inferior crown-receiving edge, and two lateral band edges. Step No. Five (5) involves cutting a mesh fabric layer pattern from the mesh fabric layer, the mesh fabric layer pattern comprising an anterior mesh end and a posterior mesh end.

Step Nos. Six (6) and Seven (7) involve positioning the deep moisture-wicking fabric layer in superior adjacency to the superficial insulative fabric layer, the deep layer perimeter substantially coinciding with the superficial layer perimeter, the superficial fold region coinciding with the deep fold region; and folding the deep moisture-wicking fabric layer pattern and the superficial insulative fabric layer pattern about the superior fold region and the deep fold region, the superficial insulative fabric layer pattern being deep to the deep moisture-wicking fabric layer pattern. Step No. Eight (8) involves marking a zipper location, the zipper location being located at the two intermediate superior superficial regions and the two intermediate superior deep regions.

Step Nos. Nine (9), Ten (10), and Eleven (11) involve stitching the medial superior superficial regions and the medial superior deep regions to one another in juxtaposed relation to form a closed superior-anterior seam; stitching the lateral superior superficial regions and the lateral superior deep regions to one another in juxtaposed relation to form a closed superior-posterior seam; and stitching the lateral superficial edges and the lateral deep edges to one another in juxtaposed relation to form a closed posterior seam. Step No. Twelve (12) involves backstitching the zipper location.

Step Nos. Thirteen (13), Fourteen (14), Fifteen (15) and Sixteen (16) involve stitching the laterally extending attachment fabric to the intermediate superior superficial regions and the intermediate superior deep regions to form a zipper attachment seam; stitching the mesh fabric layer pattern to the intermediate superior superficial regions and the intermediate deep regions in adjacency to the zipper means to form a mesh attachment seam; stitching the lateral band edges to one another to form a posterior band seam; and stitching the superior band attachment edge to the band-receiving edge to form a superior band seam, the posterior band seam being in inferior adjacency to the posterior seam.

After positioning the deep moisture-wicking fabric layer pattern in superior adjacency to the superficial insulative fabric layer pattern, an additional step may comprise the step of pinning the deep moisture-wicking fabric layer pattern to the superficial insulative fabric layer pattern. After backstitching the zipper location, an additional step may comprise the step of pinning the laterally extending attachment fabric to the intermediate superior superficial regions and the intermediate superior deep regions. After stitching the laterally extending attachment fabric to the intermediate superior superficial regions and the intermediate superior deep regions, an additional step may comprise the step of pinning the mesh fabric layer pattern to the intermediate superior superficial regions and the intermediate deep regions. After stitching the lateral band edges to one another, an additional step may comprise the step of pinning the superior band attachment edge to the band-receiving edge.

After stitching the laterally extending attachment fabric to the intermediate superior superficial regions and the intermediate superior deep regions, additional steps may comprise the steps of adjusting the deep moisture-wicking fabric layer pattern and the superficial insulative fabric layer pattern, the deep moisture-wicking fabric layer pattern being deep to the superficial insulative fabric layer pattern; topstitching the intermediate superior superficial regions and the intermediate superior deep regions to form a rectangle pattern, the rectangle pattern enveloping the slidable fastener means; and readjusting the deep moisture-wicking fabric layer pattern and the superficial insulative fabric layer pattern, the superficial insulative fabric layer pattern being deep to the deep moisture-wicking fabric layer pattern. Finally, after stitching the superior band attachment edge to the band-receiving edge, an additional step may comprise the step of surge stitching the superior-posterior seam, the superior-anterior seam, the posterior seam, the mesh attachment seam, the superior band seam, and the posterior band seam, as elected by the manufacturer.

Other objects of the present invention, as well as particular features, elements, and advantages thereof, will be elucidated in, or apparent from, the following description and the accompanying drawing figures.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT

Figure 1:
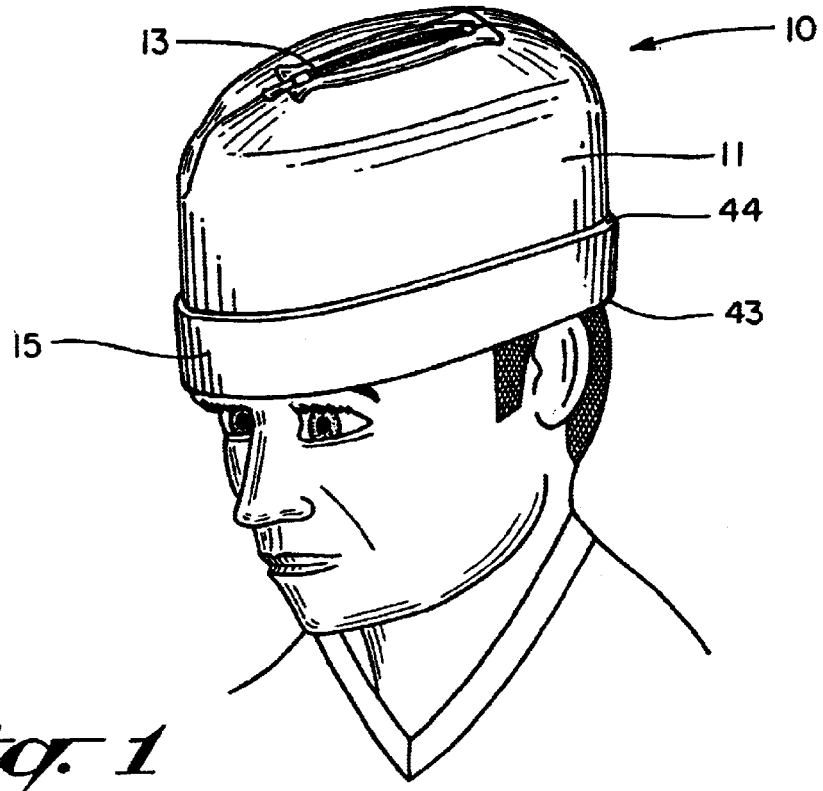
FIG. 1 is a perspective view of the preferred embodiment of the ventable ski hat showing as worn by a user with the vent aperture in a fully closed state.
Figure 2:
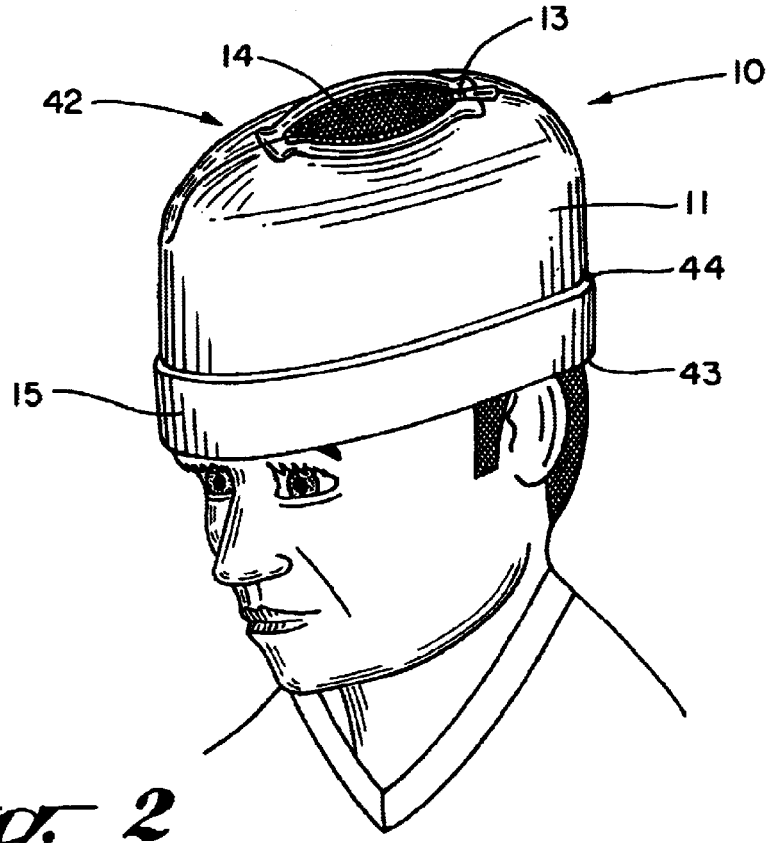
FIG. 2 is a perspective view of the preferred embodiment of the ventable ski hat showing as worn by a user with the vent aperture in a fully open state.

Referring now to the drawings, the preferred embodiment of the present invention concerns a ventable ski hat 10 or ventable hat for enabling a wearer such as a skier, snowboarder or general winter sports enthusiast to selectively retain or vent body heat from the hat as desired. Ventable ski hat 10 is generally illustrated in FIGS. 1 and 2 as worn by a user. Ventable ski hat 10 essentially comprises a hat member comprising a superior vent portion, an inferior crown-receiving portion, and open-closure means. The hat member may be further defined by comprising a superior hat member and a head band member, where the open-closure means may preferably be defined by comprising zipper means.

Figure 3:
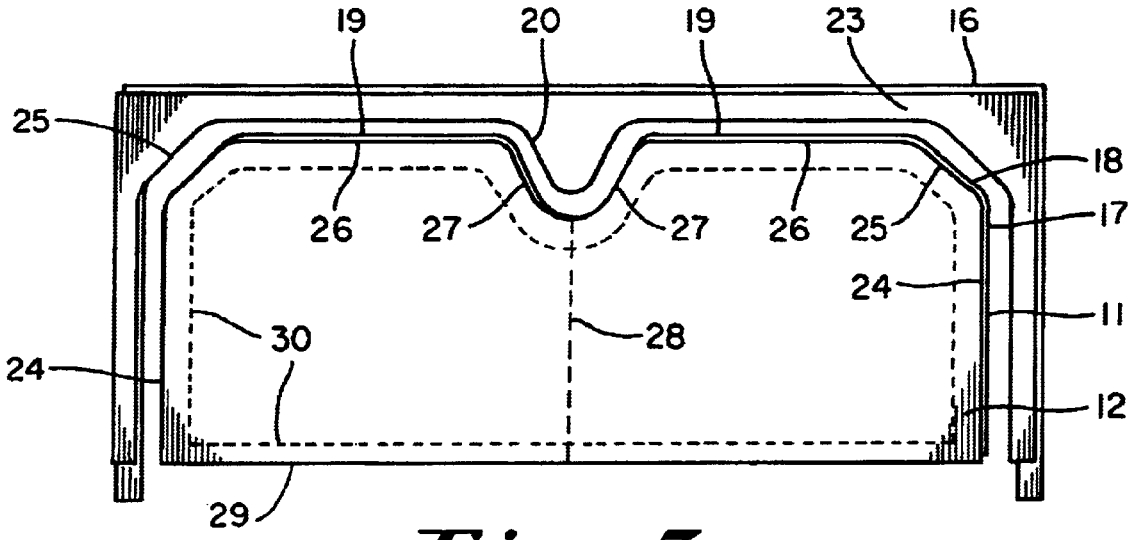
FIG. 3 is a top plan view of the deep moisture-wicking fabric layer positioned in superior adjacency to the superficial insulative fabric layer with both a deep moisture-wicking fabric layer pattern and a superficial insulative fabric layer pattern in a state of removal from the deep moisture-wicking fabric layer and the superficial insulative fabric layer.
Figure 4:
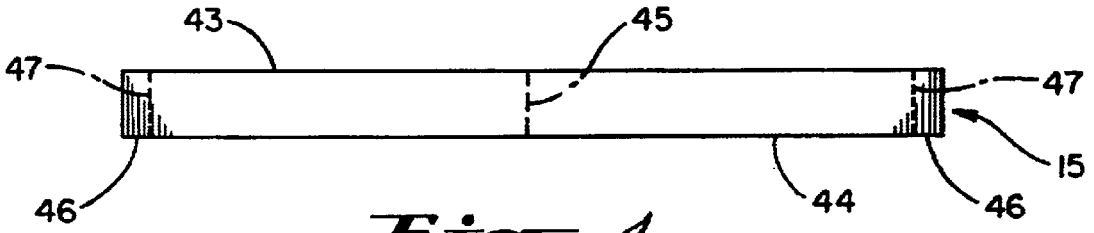
FIG. 4 is top plan view of the head band member pattern as removed from the superficial insulative fabric layer of FIG. 3.
Figure 5:
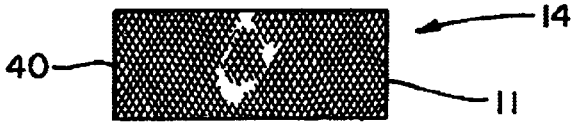
FIG. 5 is a top plan view of mesh fabric layer pattern.
Figure 8:
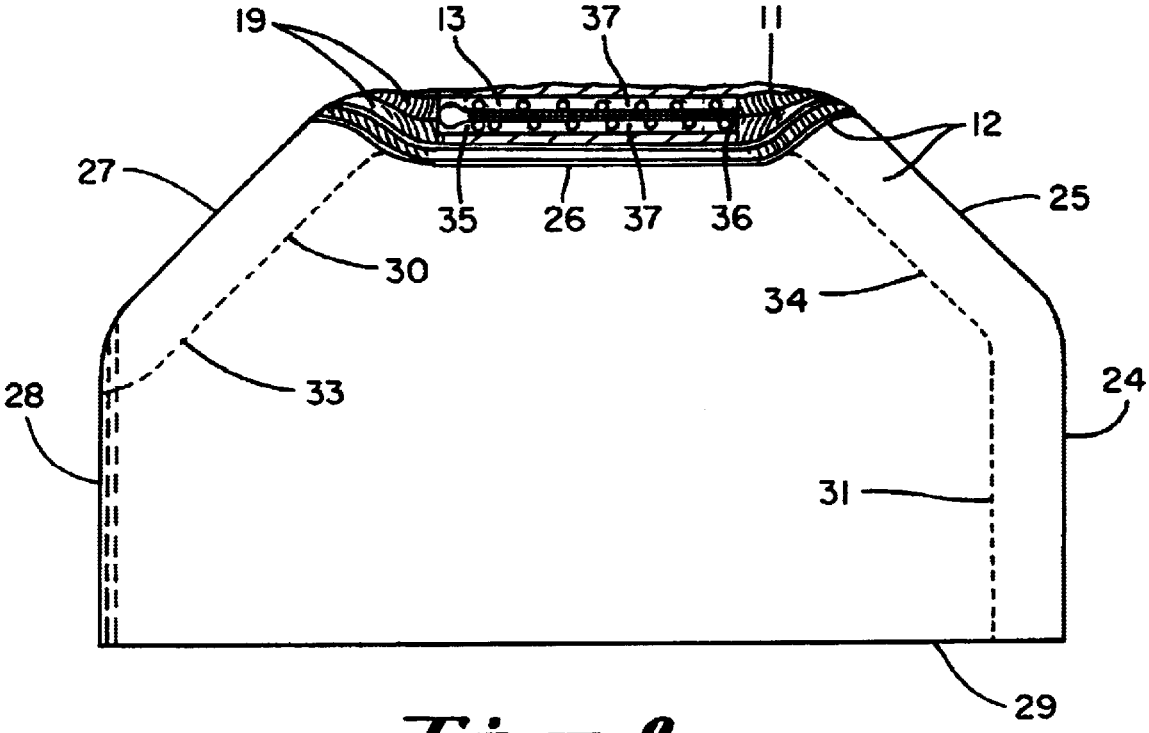
FIG. 8 is a side plan view of the superior hat member showing the zipper means being retained in position at the intermediate superior superficial regions and the intermediate superior deep regions.
Figure 9:
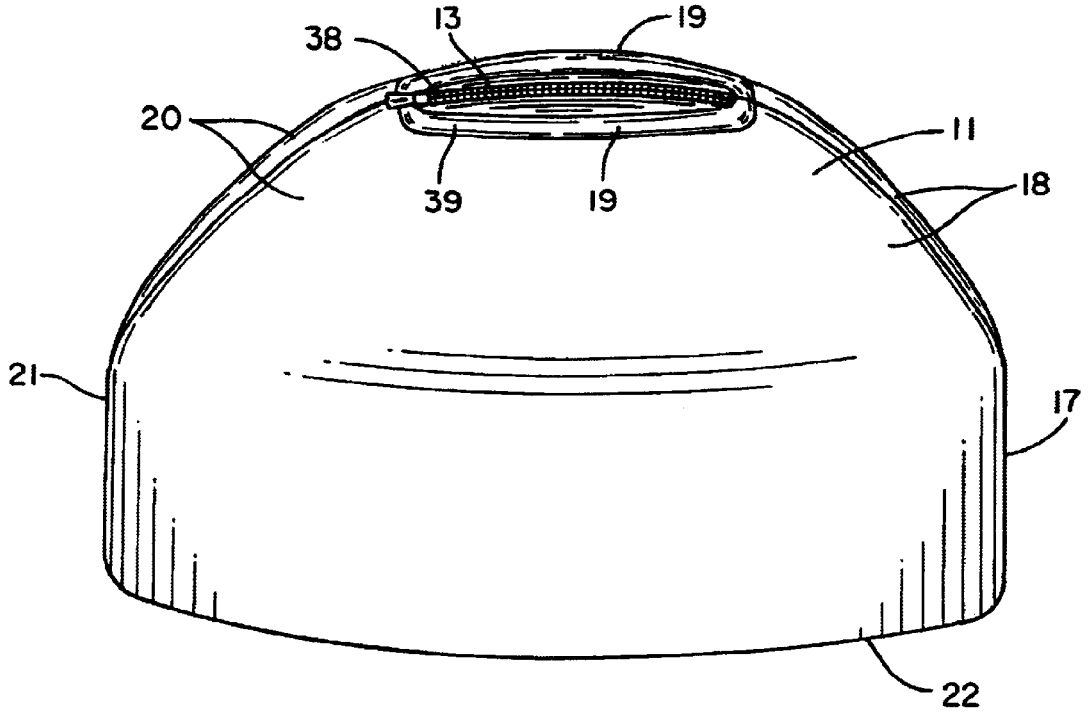
FIG. 9 is a side perspective view of the superior hat member showing the deep moisture-wicking fabric layer pattern deep to the superficial insulative fabric layer pattern or an outside-out configuration.
Figure 10:
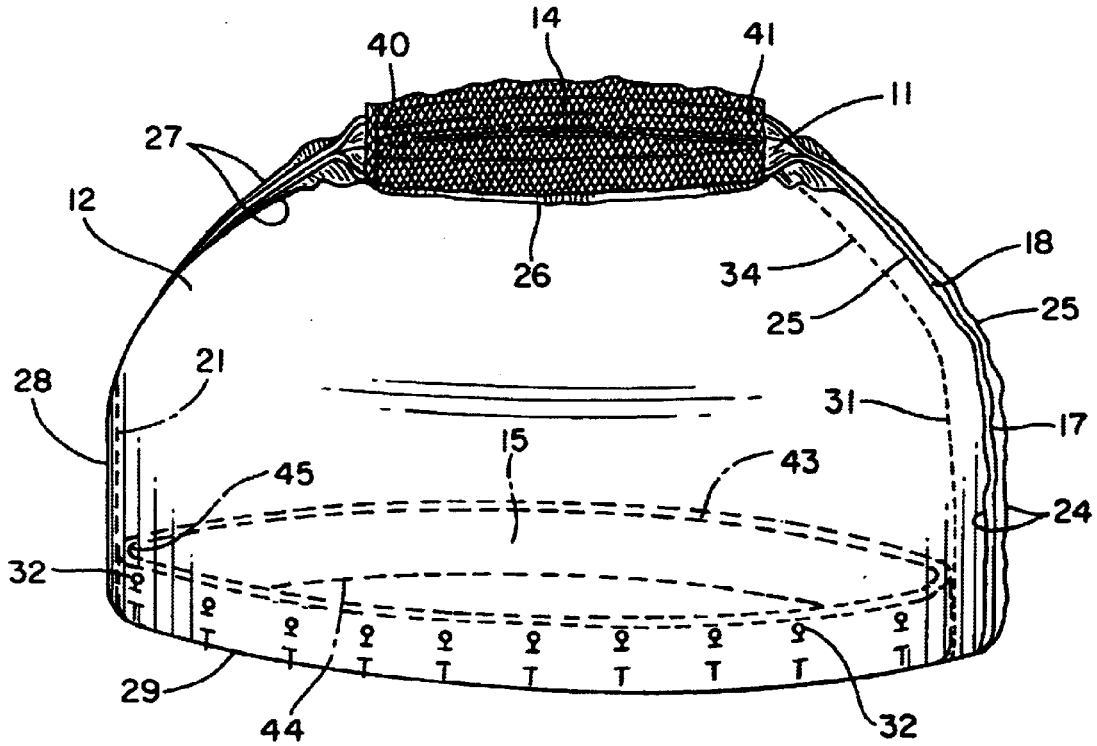
FIG. 10 is a side perspective view of the superior hat member in an inside-out configuration showing the mesh fabric layer positioned adjacent the intermediate superior superficial regions and the intermediate superior deep regions and showing the head band member being retained in position adjacent the band receiving edge of the superior hat member.

Ventable ski hat 10 is further defined by comprising a superficial insulative fabric layer 11 or superficial fabric layer pattern or superficial fabric layer as illustrated in FIGS. 1–3, and 7–10; a deep moisture-wicking fabric layer 12 or deep moisture-wicking fabric layer pattern or deep fabric layer as illustrated in FIGS. 3, 7, 8, and 10; zipper means 13 as illustrated in FIGS. 1, 2, 6, and 8; a mesh fabric layer 14 or mesh fabric layer pattern as illustrated in FIGS. 2, 5, and 10; and an insulative head band member 15 or an insulative head band member pattern or head band member as illustrated in FIGS. 1, 2, 4, and 10.

Superficial insulative fabric layer 11, deep moisture-wicking fabric layer 12, zipper means 13, mesh fabric layer 14 and the insulative head band member 15 each preferably comprise coordinate coloration or are constructed from materials that are color coordinated to increase the visual appeal of ventable ski hat 10. In this regard, it is contemplated that superficial insulative fabric layer 11 is preferably cut or otherwise removed from a visually appealing insulative fabric material 16 as generally illustrated in FIG. 3. Insulative fabric material 16 may comprise any suitable color as desired by the consumer. It should be noted, however, that superficial insulative fabric layer 11 is typically exposed to the environment when worn in a typical fashion as generally illustrated in FIG. 1 and thus will be readily seen by onlookers. Further, superficial insulative fabric layer 11 comprises that portion of ventable ski hat 10 that is most seen by the occasional onlooker. In other words, while zipper means 13 is readily viewable when ventable ski hat 10 is worn in a manner as shown, and while mesh fabric layer 14 is readily viewable when the vent aperture is in a fully open state, superficial insulative fabric layer 11 comprises the bulk of the field of view and thus the color of superficial insulative fabric layer 11 should be chosen carefully since the corresponding reflected light wavelength will comprise a significant portion of the visual appearance of ventable ski hat 10.

As noted, zipper means 13 is readily viewable and mesh fabric layer 14 is readily viewable when the vent aperture is a fully open state. In this regard, it is contemplated that zipper means 13 and mesh fabric layer 14 preferably comprise coloration that is color coordinated with the chosen color of superficial insulative fabric layer 11. For example, if the color blue is chosen for superficial insulative fabric layer 11, then zipper means 13 may comprise a similar shade of blue. Similarly, mesh fabric layer 14 may comprise blue coloration or black coloration, either of which colors may be thought to coordinate with the chosen blue coloration of superficial insulative fabric layer 11.

While not readily viewable when ventable ski hat 10 is worn as shown in FIGS. 1 and 2, deep moisture-wicking fabric layer 12 may preferably comprise coloration that is color coordinated with the chosen color of superficial insulative fabric layer 11. In this regard, it is contemplated that the user or wearer of ventable ski hat 10 will normally be able to view deep moisture-wicking fabric layer 12 as ventable ski hat 10 is placed onto the user's head and thus an attractive color is to be preferred.

Insulative head band member 15 is also preferably cut or otherwise removed from the visually appealing, insulative fabric material 16. In this regard, it is contemplated that insulative head band member 15 will also comprise any suitable color as desired by the consumer as insulative head band member 15 is preferably cut from the same piece of fabric material as superficial insulative fabric layer 11 as comparatively shown in FIGS. 3 and 4. In other words, it will be seen from an inspection of FIG. 3 that the measured width dimension of insulative fabric material 16 has a magnitude greater than the measured width dimension of a moisture-wicking fabric material 23. The greater width dimension of insulative fabric material 16 enables the manufacturer to cut insulative head band member 15 from the same piece of insulative fabric material 16 as superficial insulative fabric layer 11.

It is contemplated that any suitable fabric material may be utilized to form superficial insulative fabric layer 11 so long as the material has insulative properties. Preferably, however, superficial insulative fabric layer 11 comprises fleece or fleece like material and in this regard, it is noted that excellent results have been obtained when superficial insulative fabric layer 11 is cut or otherwise removed from insulative fabric material 16 comprising fleece materials. It is further contemplated that insulative fabric material 16 may preferably comprise fabric material having relatively high elasticity properties. In this regard, it is noted that head size varies from individual to individual. A ventable ski hat constructed from highly elastic insulative fabric material, which hat may readily conform to the head size of a given individual donning ventable ski hat 10, is thus preferable. In terms of the following specification description, it should be understood that the cited dimensions are provided assuming a relaxed fabric state.

Figure 7:
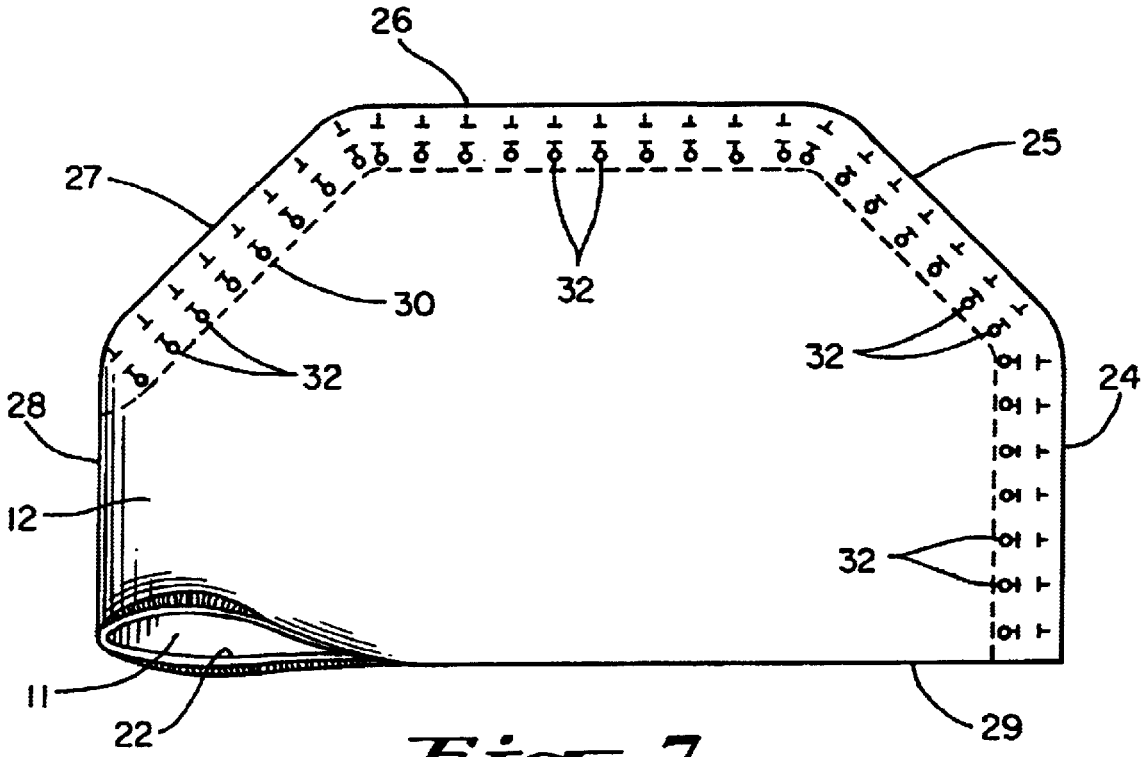
FIG. 7 is a side plan view of a superior hat member formed from the deep moisture-wicking fabric layer pattern and the superficial insulative fabric layer pattern folded about the superior fold region and the deep fold region, the superficial insulative fabric layer pattern being deep to the deep moisture-wicking fabric layer pattern or an inside out configuration.

Insulative fabric material 16 should comprise a measured length dimension about 25 to 26 inches and an overall width dimension of about 12 to 13 inches. After laying out a piece of chosen material of the described dimensions, superficial insulative fabric layer 11 is cut or otherwise removed from insulative fabric material 16 and essentially comprises two lateral superficial edges 17 as generally illustrated in FIGS. 3 and 9; two lateral superior superficial regions 18 as illustrated in FIGS. 3 and 9; two intermediate superior superficial regions 19 as illustrated in FIGS. 3, 8, and 9; and two medial superior superficial regions 20 as illustrated in FIGS. 3 and 9; a superficial fold region 21 as illustrated in FIGS. 9 and 10; an inferior superficial region 22 as illustrated in FIGS. 7 and 9; and a superficial layer perimeter, which perimeter essentially comprises lateral superficial edges 17, lateral superior superficial regions 18, intermediate superior superficial regions 19, medial superior superficial regions 20, and inferior superficial region 22. Lateral superficial edges 17, lateral superior superficial regions 18, intermediate superior superficial regions 19, and medial superior superficial regions 20 thus form a superficial layer superior perimeter, and inferior superficial region 22 thus forms a superficial layer inferior perimeter.

Superficial fold region 21 essentially divides superficial insulative fabric layer 11 into substantially identical superficial lateral halves and thus constitutes a midline about which the superficial lateral halves may be folded. As indicated, superficial fold region 21 is referenced in FIGS. 9 and 10. Lateral superficial edges 17 are laterally opposite one another in relation to superficial fold region 21 at the extreme ends of superficial insulative layer 11 where the right most superficial lateral edge is referenced in FIG. 3 and the left most superficial lateral edge is referenced in FIG. 9. Lateral superior superficial regions 18 are laterally opposite one another at the extreme superior ends of superficial insulative layer 11 where the right most superior superficial region 18 is referenced in FIG. 3 and where both superior superficial regions 18 are referenced in FIG. 9. Medial superior superficial regions 20 are laterally opposite one another at those points in nearest adjacency to superficial fold region 21 where the left most medial superior superficial region 20 is illustrated in FIG. 3 and where both medial superior superficial regions 20 are illustrated in FIG. 9. Intermediate superior superficial regions 19 are laterally opposite one another intermediate medial superior superficial regions 19 and lateral superior superficial regions 18. Both intermediate superior superficial regions 19 are referenced in FIGS. 3, 8 and 9. Inferior superficial region 22 runs the entire length of superficial insulative fabric layer 11 and is the inferior most edge of superficial insulative fabric layer 11 as generally illustrated in FIGS. 7 and 9.

It is contemplated that any suitable fabric material may be utilized to form deep moisture-wicking fabric layer 12 so long as the material has moisture-wicking capability or liquid conveyance or capillary action properties. Preferably, however, deep moisture-wicking fabric layer 12 comprises or is constructed from a fabric chosen from an exemplary group of fabrics commonly sold in interstate commerce under the brand names or trademarks: COOLMAX, COOLMAX LITE, BIPOLAR 100, BIPOLAR 200, or MTF. In this regard, excellent results have been obtained when deep moisture-wicking fabric layer 12 is cut or otherwise removed from moisture-wicking fabric material 23 comprising these types of fabric material as referenced in FIG. 3. These types of materials generally have excellent moisture wicking properties and are designed to be worn next-to-the-skin so as to wick perspiration from the skin surface. It is further contemplated that moisture-wicking fabric material 23 may preferably also comprise fabric material having relatively high elasticity properties. As has been earlier noted, head size varies from individual to individual and thus a ventable ski hat constructed from highly elastic moisture-wicking fabric material is preferable. In terms of the following specification description, it should be understood that the cited dimensions are provided assuming a relaxed fabric state.

When a moisture-wicking material of the type described is used in combination with an outer layer of fleece as is the case in the present invention, moisture removal from the skin surface is substantially enhanced. Moisture-wicking fabric material 23 should comprise a measured length dimension about 25 to 26 inches and an overall width dimension of about 8½ to 9 inches. In this regard, it should be noted that the overall width dimension of moisture-wicking fabric material 23 has a preferred magnitude less than the overall width dimension of insulative fabric material 16. This is because it is contemplated that insulative head band member 15 is cut from the same piece of insulative fabric material 16 as superficial insulative fabric layer 11 as earlier discussed.

Deep moisture-wicking fabric layer 12 essentially comprises two lateral deep edges 24 as generally illustrated in FIGS. 3, 7, 8 and 10; two lateral superior deep regions 25 as generally illustrated in FIGS. 3, 7, 8, and 10; two intermediate superior deep regions 26 as generally illustrated in FIGS. 3, 7, 8, and 10; two medial superior deep regions 27 as illustrated in FIGS. 3, 7, 8, and 10; a deep fold region 28 as illustrated in FIGS. 3, 7, 8, and 10; an inferior deep region 29 as illustrated in FIGS. 3, 7, 8, and 10; and a deep layer perimeter. Similar to the superficial layer perimeter, deep layer perimeter essentially comprises lateral deep edges 24, lateral superior deep regions 25, intermediate superior deep regions 26, medial superior deep regions 27 and inferior deep region 29. Lateral deep edges 24, lateral superior deep regions 25, intermediate superior deep regions 26, and medial superior deep regions 27 thus form a deep layer superior perimeter, and inferior deep region 29 thus forms a deep layer inferior perimeter. Deep fold region 28 effectively divides deep moisture-wicking fabric layer 12 into substantially identical deep lateral halves and thus constitutes a midline about which the deep lateral halves may be folded. As earlier indicated, deep fold region 28 is referenced in FIGS. 3, 7, 8, and 10. Lateral deep edges 24 are laterally opposite one another at the extreme ends of deep moisture-wicking layer 12 where both deep lateral edges are referenced in FIGS. 3 and 10, and the left most deep lateral edge is referenced in FIGS. 7 and 8. Lateral superior deep regions 25 are laterally opposite one another at the extreme superior ends of deep moisture-wicking fabric layer 12 where both deep superficial regions 25 is referenced in FIGS. 3 and 10, and where the left most lateral superior deep region 25 is referenced in FIGS. 7 and 8. Medial superior deep regions 27 are laterally opposite one another at those points in nearest adjacency to deep fold region 28 where both medial superior deep regions 27 are illustrated in FIGS. 3 and 10, and where the left most medial superior deep region 27 is illustrated in FIGS. 7 and 8. Intermediate superior deep regions 26 are laterally opposite one another intermediate medial superior deep regions 27 and lateral superior deep regions 25. Both intermediate superior deep regions 26 are referenced in FIG. 3 and the left most intermediate superior deep region 26 is referenced in FIGS. 7, 8, and 10. Inferior deep region 29 runs the entire length of deep moisture-wicking fabric layer 12 and is the inferior most edge of deep moisture-wicking fabric layer 12 as generally illustrated in FIGS. 7, 8 and 10.

Deep moisture-wicking fabric layer 12 is preferably positioned in adjacency to superficial insulative fabric layer 11 such that the deep layer perimeter substantially coincides with the superficial layer perimeter. As illustrated in FIG. 3, deep moisture-wicking fabric layer 12 is preferably positioned in superior adjacency to superficial insulative fabric layer 11. When superficial insulative fabric layer 11 is cut from insulative fabric material 16 the overall measured length from the left most lateral superficial edge 17 to the right most lateral superficial edge 17 is about 25 inches. It should be noted that the specified overall length from the left most lateral superficial edge 17 to the right most lateral superficial edge 17 will ultimately depend on the head size being addressed for a particular ventable ski hat 10. In other words, smaller head sizes will require an inferior superficial region 22 with an overall length shorter than 25 inches. Similarly, when deep moisture-wicking fabric layer 12 is cut from moisture-wicking fabric material 23, the overall measured length from the left most lateral deep edge 24 to the right most lateral deep edge 24 is about 25 inches. It should be noted that the specified overall length from the left most lateral deep edge 24 to the right most lateral deep edge 24 will also ultimately depend on the head size being addressed for a particular ventable ski hat 10. In other words, smaller head sizes will require an inferior deep region 29 with an overall length shorter than 25 inches. Bearing in mind that insulative fabric material 16 and moisture-wicking fabric material 23 may comprise highly elastic type fabric, it is believed that one with ordinary skill in the art of outer wear manufacture in general or head wear manufacture in particular may experiment with the overall length dimension here described without undue experimentation.

Further, the preferred measured width (or effective height dimension of ventable ski hat 10) from both the intermediate superior superficial regions 19 and the intermediate deep regions 26 to both the inferior superficial region 22 and inferior deep region 29 is about 8½ inches. It should be noted that the specified overall width or effective height dimension from the both the intermediate superior superficial regions 19 and the intermediate deep regions 26 to both the inferior superficial region 22 and inferior deep region 29 will ultimately depend on the head size being addressed for a particular ventable ski hat 10. In other words, larger head sizes may require a measured width dimension with a greater overall width, the width having a magnitude greater than 8½ inches. Bearing in mind that insulative fabric material 16 and moisture-wicking fabric material 23 may comprise highly elastic type fabric, it is further believed that one with ordinary skill in the art of outer wear manufacture in general or head wear manufacture in particular may experiment with the overall width dimension here described without undue experimentation.

Deep moisture-wicking fabric layer 12 and superficial insulative fabric layer 11 are folded about coinciding superficial fold region 21 and deep fold region 28 such that superficial insulative fabric layer 11 is deep to deep moisture-wicking fabric layer 12. In other words, superficial insulative fabric layer 11 is folded upon itself and deep moisture-wicking fabric layer 12 effectively sandwiches superficial insulative fabric layer 11. It will be seen that if ventable ski hat 10 is being hand-sewn or hand-stitched, deep moisture-wicking fabric layer 12 preferably comprises a seam line 30 as illustrated in FIGS. 3, 7, and 8. Preferably, seam line 30 is positioned about 1 inch from the deep layer perimeter comprising lateral deep edges 24, lateral superior deep regions 25, intermediate superior deep regions 26, and medial superior deep regions 27. Further, seam line 30 is positioned about ½ inches from inferior deep region 29 comprising the inferior portion of the deep layer perimeter. Seam line 30 generally comprises markings made on the material so that the individual sewing or stitching the regions may more readily follow a sew line template or a stitch line template.

After folding deep moisture-wicking fabric layer 12 and superficial insulative fabric layer 11 about superior fold region 21 and deep fold region 28, the hat manufacturer may pin deep moisture-wicking fabric layer 12 to superficial insulative fabric layer 11 along or adjacent the medial superior regions, the intermediate superior regions, the lateral superior regions, and the lateral edges as generally illustrated in FIG. 7, which pins are referenced at 32. The method of pinning is preferably used to hold material in place during the sewing or stitching procedures. After pinning deep moisture-wicking fabric layer 12 to superficial insulative fabric layer 11, the location for zipper means 13 is preferably marked. The method of marking the zipper location is preferably used for determining the location for backstitching to properly hold zipper means 13. Certain regions of ventable ski hat 10 are then preferably stitched together as summarized hereinafter.

At the election of the hat manufacturer, the stitch procedures may follow in any order so long as the described seams result. For example, medial superior superficial regions 20 and medial superior deep regions 27 are stitched to one another in juxtaposed relation to form a closed superior-anterior seam 33 as illustrated in FIG. 8; lateral superior superficial regions 18 and the lateral superior deep regions 25 are stitched to one another in juxtaposed relation to form a closed superior-posterior seam 34 as illustrated in FIGS. 8 and 10; and lateral superficial edges 17 and lateral deep edges 24 are stitched to one another in juxtaposed relation to form a closed posterior seam 31 as illustrated in FIGS. 8 and 10.

Intermediate superior superficial regions 19 and intermediate superior deep regions 26 thus define a superior vent aperture. It is contemplated that the preferred configuration of the vent aperture resembles a substantially elliptical vent aperture, which vent aperture necessarily further comprises a major axis or longitudinal axis and a minor axis or latitudinal axis. In practice, the present invention is designed such that the major axis will be medially aligned along the wearer's head in the midsagital plane when ventable ski hat 10 is donned by the wearer. As generally illustrated in FIG. 2, the vent aperture further comprises an anterior vent end and a posterior vent end. The anterior vent end is adjacent the anterior portion of the wearer's head or toward the facial region and the posterior vent end is adjacent the posterior portion of the wearer's head near the back of the head. In other words, the major axis of the vent aperture is designed to be medially aligned along the wearer's head from the superior-anterior seam to the superior-posterior seam, the vent aperture preferably being of an elliptical configuration when in a fully open state. Preferably, the major axis has a measured dimension ranging from about 5 inches to 6 inches, which measured dimension corresponds to the preferred length of the intermediate superior regions. The minor axis has a preferable maximum measured dimension of about 1.5 inches. As has been alluded to earlier in this description, ventable ski hat 10 is designed to be a visually attractive hat. The preferred dimensions of the major axis and the minor axis have thus been specified at between 5–6 inches and at most 1.5 inches, respectively, so as to contribute to the overall aesthetic appeal of ventable ski hat 10. In this regard, the noted dimensions provide ventable ski hat 10 with maximized venting ability as well as a symmetrical shape as a means to increase the visual appeal of ventable ski hat 10. It is believed that dimensions that markedly differ from those herein cited will form a ventable hat that either suffers in its venting function or suffers in its visual attractiveness or visual appeal.

After stitching the certain regions as described above, zipper means 13 is installed at the vent aperture as a means to selectively open and close the vent aperture. Other open-closure means are contemplated such as hook and loop type fastening means, button means, or snap means. However, these examples of open-closure means do not provide the excellent results that zipper means demonstrate. As earlier stated, it is preferred that the zipper location first be backstitched, which backstitching is performed at the anterior vent end and the posterior vent end. Further, it is preferred that an extra ½ inch seam be used for properly stitching zipper means 13.

It should be noted that there are two basic avenues for preparing the zipper location at the vent aperture. The first avenue involves leaving both the superficial and deep intermediate superior regions unstitched substantially as described hereinabove. The second avenue involves stitching the intermediate superior regions as the medial superior regions, lateral superior regions and lateral edges are stitched, backstitching at the intermediate superior regions. This second avenue enables the manufacturer to continuously stitch the superior regions and lateral edges without stopping and restarting the stitch at the ends of the intermediate superior regions. However, if the manufacturer elects to utilize the second avenue as described, then the manufacturer will necessarily have to open the intermediate superior regions between the backstitched intermediate superior regions using a ripper or similar other device.

Additionally, there are two basis types of zipper means 13 that may be utilized, namely, a cut-to-size zipper or a manufactured zipper. If using a cut-to-size zipper, the manufacturer must first cut a zipper structure to size. The overall length of a cut-to-size zipper should be about 5–6 inches plus about 1 inch. The cut zipper structure must then be prepared for use. Preparing the zipper for use typically involves zigzag stitching the portion of the zipper track that will serve as the zipper bottom. The extra 1 inch used when cutting the zipper structure provides ample end zipper structure for stitching and helps to keeps the zipper head from going off the track in either direction after the zipper structure is stitched in position. In others words, because the zipper head will only be permitted to move within the 5–6 inch vent aperture's major axis, the zipper head will be stopped by the anterior vent end and the posterior vent end and thus not be allowed to move off the track. If using a manufactured zipper, the zipper bottom and the zipper top opposite the zipper bottom will already be set, thus preventing the zipper head from running off the zipper track. The overall length of the manufactured zipper will preferably be 5–6 inches as directed by the hat manufacturer.

Figure 6:
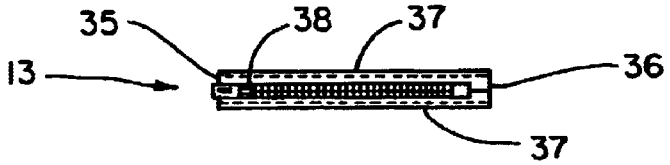
FIG. 6 is a top plan view of the zipper means.

Zipper means 13 essentially comprises an anterior zipper end 35, a posterior zipper end 36, laterally extending attachment fabric 37, and slidable fastener means 38 all as illustrated in FIG. 6. As noted the preferred overall length of zipper means should measure about 5–6 inches. The preferred width of zipper means 13 from a first lateral side of laterally extending attachment fabric 37 to a second lateral side of laterally extending attachment fabric 37 is about 1 inch. Zipper means 13 is preferably pinned in place at the vent aperture between the backstitched areas such that anterior zipper end 35 is adjacent the anterior vent end and posterior zipper end 36 is adjacent the posterior vent end as generally illustrated in FIG. 8. Laterally extending attachment fabric 37 is then stitched to intermediate superior superficial regions 19 and intermediate superior deep regions 26. Slidable fastener means 38 or the zipper head and zipper track having a main zipper axis are intermediate laterally extending fabric 27 medially aligned from the anterior vent end to the posterior vent end substantially parallel with the major axis and are designed to enable the user to selectively open and close the vent aperture as required.

After stitching laterally extending attachment fabric 37 to intermediate superior superficial regions 19 and intermediate superior deep regions 26, it is preferred that the manufacturer adjust deep moisture-wicking fabric layer 12 and superficial insulative fabric layer 11 such that deep moisture-wicking fabric layer 12 is deep to superficial insulative fabric layer 11 as generally shown in FIG. 9. In other words, it is preferred that the hat structure be turned "right side" out or outside out. This step enables the manufacturer to top-stitch the intermediate superior regions to form a rectangle pattern, the rectangle pattern enveloping or bordering slidable fastener means 38 as generally illustrated in FIG. 9 and as referenced at 39. The top-stitching is preferably placed about ½ inch from the vent aperture perimeter. If the manufacturer elects to follow the second avenue of hat stitching as described above, it is preferred that the sections between the backstitched areas be ripped at this point. The hat structure is then preferably readjusted such that deep moisture-wicking fabric layer 12 and superficial insulative fabric layer 11 are turned "right side" in or outside in, superficial insulative fabric layer 11 once again being deep to deep moisture-wicking fabric layer 12.

It is contemplated that any suitable mesh fabric material may be utilized to form mesh fabric layer 14 so long as the mesh fabric material has comprises mesh apertures no greater than about 1 millimeter (1 mm) in magnitude. It should be understood that mesh fabric layer 14 is designed to filter matter such as snow and other precipitate from entering the vent aperture when the vent aperture is in an open state. To achieve proper filtering, it is necessary to choose mesh fabric material having proper aperture dimensions. In this regard, excellent results have been obtained using 1 mm nylon or polyester diamond mesh fabric. At the manufacturer's election, the mesh fabric material may preferably comprise moisture-absorbing properties, Ultra Violet (UV) protective properties, and load bearing properties to improve the desirability of ventable ski hat 10. The essential specification, however, is the size of the mesh aperture, which apertures should have dimensions no greater than about 1 mm across the aperture.

Mesh fabric layer 14 preferably comprises an anterior mesh end 40 and a posterior mesh end 41 as illustrated in FIGS. 5 and 10. Mesh fabric layer 14 is preferably first pinned to the intermediate superior regions as a means to hold mesh fabric layer in place prior to stitching. After pinning mesh fabric layer 14 to the intermediate superior regions, mesh fabric layer is stitched to the intermediate superior regions in adjacency to zipper means 13 such that anterior mesh end 40 is adjacent the anterior vent end and posterior mesh end 41 is adjacent the posterior vent end. Mesh fabric layer 14 and zipper means 13 thus cooperatively form a selectively ventable, mesh-filtered vent 42, mesh-filtered vent 42 being substantially elliptical when in a fully open state as generally illustrated in FIG. 2. Notably, the mesh fabric layer is sized and shaped to be substantially taut when the mesh-filtered vent is in a fully open state. In other words, at maximum venting, it is preferred that the minor axis of the vent aperture should not exceed 1½ inches. It should be noted that the vent aperture may otherwise exhibit a generally undesirable width that is greater than 1½ inches. Due to the overall shape of ventable ski hat 10, added width to mesh fabric layer 14 is necessary to allow for the maximum minor axis of 1½ inches when ventable ski hat is worn and when mesh-filtered vent 42 is in a fully open state. Excess mesh fabric located adjacent anterior mesh end 40 and posterior mesh end 41 after stitching may be tacked down as desired by the manufacture.

The preferred overall length of mesh fabric layer 14 is about 5–6 inches, which dimension coincides with the preferred length of zipper means 13. The preferred overall width of mesh fabric layer 14 is about 3¼ inches. It should be noted, however, that the width of mesh fabric layer 14 is adjustable depending on the head size being addressed for ventable ski hat 10, since the width of mesh fabric layer 14 operates to restrict the vent aperture from opening more than 1½ inches along the minor axis. As earlier indicated, the vent aperture in coordination with mesh fabric layer 14 is designed to open with sufficient degree to provide adequate venting yet maintain the intended overall shape of ventable ski hat 10. Too large of a vent aperture will distort the shape of ventable ski hat 10 while venting, which distortion would contribute to a visually unappealing ventable ski hat 10.

Inferior superficial region 22 and inferior deep region 29 together define a double layered band-receiving edge, which double-layered band-receiving edge is designed to receive insulative head band member 15. As earlier described, insulative head band member 15 is preferably cut from insulative fabric material 16 and thus comprises the same coloration as superficial insulative fabric layer 11. Insulative head band member 15, may however, be cut from any suitable material that functions to retain body heat in adjacency to the wearer's head. Preferably, insulative head band member 15 comprises an overall length of about 25 inches and an overall width of about 3 inches, which measurements are based on a ventable ski hat size, which may be generally regarded as "large." In this regard, it should be noted that the cited specifications for insulative head band member 15 are adjustable depending on the head size being addressed for a given ventable ski hat 10.

Insulative head band member 15 essentially comprises a superior band attachment edge 44 as illustrated in FIGS. 1, 2, 4, and 10; an inferior crown-receiving edge 43 as illustrated in FIGS. 1, 2, 4, and 10; a band fold region 45 as illustrated in FIGS. 4 and 10; and two laterally opposite band edges 46 as illustrated in FIG. 4. It will be seen from an inspection of FIG. 4 that insulative head band member 15 preferably further comprises a band stitch line 47 adjacent each band edge 46 about one inch from the extreme ends thereof. Band stitch lines 47 comprise markings so that the individual sewing or stitching the marked regions by hand may more readily follow a sew line template or a stitch line template.

Insulative head band member 15 is folded about band fold region 45 and lateral band edges 46 are stitched to one another along band stitch lines 47 to form a posterior band seam. Preferably, insulative head band seam 15 is pinned in superficial adjacency to the double layered band-receiving edge as generally illustrated in FIG. 10 where the pins are referenced at 32. Superior band attachment edge 44 is stitched to the double-layered band-receiving edge preferably using ½ inch seam to form a superior band seam whereby the posterior band seam is in inferior adjacency to the posterior seam. Inferior crown-receiving edge 43 is designed to receive a skier's head as generally illustrated in FIGS. 1 and 2. From an inspection of FIG. 10, it will be seen that inferior crown-receiving edge 43 is in a superior position. After stitching superior band attachment edge 44 to the double-layered band-receiving edge, inferior crown-receiving edge 43 may be turned down about the superior band seam to receive the wearer's head as illustrated in FIGS. 1 and 2. Before turning down inferior crown-receiving edge 43, it is preferable to finish all appropriate seams with a surge stitch. In this last regard, it is noted that a surge stitch is a quick and easy way to cleanly finish an edge. The surge stitch cuts the fabric evenly and binds pieces together preventing a pulling apart of seams. For all seams excluding seams at the zipper location, the surge stitch can be as close as ¼ inch.

It is noted that a wearer's head necessarily comprises a superior head surface. It will be understood that mesh fabric layer 14 and zipper means 13 are situated or are in spaced relation in superior adjacency to the superior head surface so as to define an insulative air layer above the superior head surface. Slidable fastener means 38 thus enable a wearer of ventable ski hat 10, for example, a skier, to selectively retain or vent body heat from the insulative air layer, as required.

It will be further understood that the present invention provides a method of manufacturing a ventable ski hat, whereby the method of manufacture essentially comprising the steps of (1) providing a superficial insulative fabric layer, a deep moisture-wicking fabric layer, a mesh fabric layer, and zipper means, the zipper means essentially comprising laterally extending attachment fabric and slidable fastener means. Step No. Two (2) involves cutting a superficial insulative fabric layer pattern from the superficial insulative fabric layer, the superficial insulative fabric layer pattern comprising two lateral superficial edges, two lateral superior superficial regions, two intermediate superior superficial regions, two medial superior superficial regions, a superficial fold region, an inferior superficial region, the superficial fold region dividing the superficial insulative fabric layer pattern into substantially identical superficial lateral halves. Step No. Three (3) involves cutting a deep moisture-wicking fabric layer pattern from the deep moisture-wicking fabric layer, the deep moisture-wicking fabric layer comprising two lateral deep edges, two lateral superior deep regions, two intermediate superior deep regions, two medial superior deep regions, a deep fold region, an inferior deep region, a deep layer superior perimeter and a deep layer inferior perimeter, the deep fold region dividing the deep moisture-wicking fabric layer pattern into substantially identical deep lateral halves.

Step No. Four (4) involves cutting a head band member pattern from the superficial insulative fabric layer, the insulative head band member pattern comprising a superior band attachment edge, an inferior crown-receiving edge, a band fold region, and two lateral band edges. Step No. Five (5) involves cutting a mesh fabric layer pattern from the mesh fabric layer, the mesh fabric layer pattern essentially comprising an anterior mesh end and a posterior mesh end.

Step Nos. Six (6) and Seven (7) involve positioning the deep moisture-wicking fabric layer in superior adjacency to the superficial insulative fabric layer, the deep layer perimeter substantially coinciding with the superficial layer perimeter, the superficial fold region coinciding with the deep fold region; and folding the deep moisture-wicking fabric layer pattern and the superficial insulative fabric layer pattern about the superior fold region and the deep fold region. The superficial insulative fabric layer pattern is thus deep to the deep moisture-wicking fabric layer pattern. Step No. Eight (8) involves marking a zipper location, the zipper location being located at the two intermediate superior superficial regions and the two intermediate superior deep regions.

Step Nos. Nine (9), Ten (10), and Eleven (11) involve stitching the medial superior superficial regions and the medial superior deep regions to one another in juxtaposed relation to form a closed superior-anterior seam; stitching the lateral superior superficial regions and the lateral superior deep regions to one another in juxtaposed relation to form a closed superior-posterior seam; and stitching the lateral superficial edges and the lateral deep edges to one another in juxtaposed relation to form a closed posterior seam. Step No. Twelve (12) involves backstitching the zipper location.

Step Nos. Thirteen (13), Fourteen (14), Fifteen (15) and Sixteen (16) involve stitching the laterally extending attachment fabric to the intermediate superior superficial regions and the intermediate superior deep regions to form a zipper attachment seam; stitching the mesh fabric layer pattern to the intermediate superior superficial regions and the intermediate deep regions in adjacency to the zipper means to form a mesh attachment seam; stitching the lateral band edges to one another to form a posterior band seam; and stitching the superior band attachment edge to the band-receiving edge to form a superior band seam, the posterior band seam being in inferior adjacency to the posterior seam.

After folding the deep moisture-wicking fabric layer pattern and the superficial insulative fabric layer pattern about the superior fold region and the deep fold region, an additional step may comprise the step of pinning the deep moisture-wicking fabric layer pattern to the superficial insulative fabric layer pattern. After backstitching the zipper location, an additional step may comprise the step of pinning the laterally extending attachment fabric to the intermediate superior superficial regions and the intermediate superior deep regions. After stitching the laterally extending attachment fabric to the intermediate superior superficial regions and the intermediate superior deep regions, an additional step may comprise the step of pinning the mesh fabric layer pattern to the intermediate superior superficial regions and the intermediate deep regions. After stitching the lateral band edges to one another, an additional step may comprise the step of pinning the superior band attachment edge to the band-receiving edge.

After stitching the laterally extending attachment fabric to the intermediate superior superficial regions and the intermediate superior deep regions, additional steps may comprise the steps of adjusting the deep moisture-wicking fabric layer pattern and the superficial insulative fabric layer pattern, the deep moisture-wicking fabric layer pattern being deep to the superficial insulative fabric layer pattern; topstitching the intermediate superior superficial regions and the intermediate superior deep regions to form a rectangle pattern, the rectangle pattern enveloping the slidable fastener means; and readjusting the deep moisture-wicking fabric layer pattern and the superficial insulative fabric layer pattern, the superficial insulative fabric layer pattern being deep to the deep moisture-wicking fabric layer pattern. Finally, after stitching the superior band attachment edge to the band-receiving edge, an additional step may comprise the step of surge stitching the superior-posterior seam, the superior-anterior seam, the posterior seam, the mesh attachment seam, the superior band seam, and the posterior band seam, as elected by the manufacturer.

While the above description provides preferred methods for manufacturing a ventable hat, it is further contemplated that the methods may essentially comprise the steps of (1) providing a hat member fabric pattern and open-closure means. Preferably, the open-closure means may be further defined by comprising zipper means, the zipper means comprising laterally extending attachment fabric, and slidable fastener means; (2) cutting a hat member pattern from the hat member fabric pattern, the hat member pattern comprising two lateral edges, two lateral superior regions, two intermediate superior regions, two medial superior regions, a fold region, an inferior region, and a perimeter, the fold region dividing the hat member pattern into substantially identical lateral halves; (3) folding the hat member pattern about the fold region; (4) stitching the medial superior regions to one another in juxtaposed relation to form a closed superior-anterior seam; (5) stitching the lateral superior regions to one another in juxtaposed relation to form a closed superior-posterior seam; (6) stitching the lateral edges to one another in juxtaposed relation to form a closed posterior seam; and (7) installing the open-closure means at the intermediate superior regions. In this last regard it is contemplated that the installation of open-closure means may preferably comprise stitching the laterally extending attachment fabric to the intermediate superior regions to form a zipper attachment seam.

It is further contemplated that the method of manufacturing the ventable hat may comprise an additional step after providing a hat member fabric pattern and zipper means, the additional step comprising the step of cutting a head band pattern from the hat member fabric pattern, the head band pattern comprising a superior band attachment edge, an inferior crown-receiving edge, and two lateral band edges. Further, it is contemplated that the method of manufacturing the ventable hat may comprise an additional step after stitching the laterally extending attachment fabric to the intermediate superior regions, the method comprising the additional step of stitching the lateral band edges to one another to form a posterior band seam. Further, it is contemplated that the method of manufacturing the ventable hat may comprises an additional step after stitching the lateral band edges to one another to form a posterior band seam, the method comprising the step of stitching the superior band attachment edge to the inferior edge to form a superior band seam, the posterior band seam being in inferior adjacency to the posterior seam. Further still, it is contemplated that the method of manufacturing the ventable hat may comprises an additional step after folding the hat member pattern about the fold region, the additional step comprising the step of marking a zipper location, the zipper location being located at the two intermediate superior regions.

It is further contemplated that the method of manufacturing the ventable hat may comprises an additional step after stitching the lateral edges to one another, the additional step comprising the step of backstitching the zipper location. Still further, it is contemplated that the method of manufacturing the ventable hat may comprises an additional step after stitching the laterally extending attachment fabric to the intermediate superior regions, the additional step comprising the step of surge stitching at least one hat seam, the hat seam being chosen from the group consisting of the superior-posterior seam, the superior-anterior seam, the posterior seam, the superior band seam, and the posterior band seam.

It will be seen that the present invention further provides a low cost, ventable ski hat easily manufactured from an insulative type fabric, such as fleece, for enabling a skier or other user to selectively retain or vent body heat during strenuous winter sporting activities, as required by the winter sports enthusiast. In this regard, it will be seen that present invention provides a ventable ski hat, which essentially comprises a superior vent portion and an inferior crown-receiving portion. Specifically, it will be seen that the present invention provides an insulative, ventable ski hat wherein the superior vent portion comprises an anterior-superior portion, a posterior-superior portion and a selectively-ventable vent aperture intermediate the anterior-superior portion and the posterior-superior portion. It will be further seen that the present invention provides an insulative, ventable ski hat wherein the vent aperture comprises open-closure means for enabling the user to selectively vent the vent aperture. In this last regard, it will be seen that the present invention provides a ventable ski hat having a vent aperture that is substantially elliptical in configuration when in a fully open state and substantially linear when in a fully closed state.

Additionally, it will be seen that the present invention provides a ventable ski hat having an elliptical vent aperture, which vent aperture necessarily comprises a major axis and a minor axis, the major axis of the elliptically shaped vent aperture being designed for medial alignment along a wearer's head from the anterior-superior portion to the posterior-superior portion and having a measured dimension of about 5–6 inches. It will be further seen that present invention provides an insulative, ventable ski hat wherein the open-closure means is designed to be in spaced relation in superior adjacency to the superior head surface of a wearer when donned by a wearer thereby defining an insulative air layer between the superior head surface and the open-closure means. Still further, it will be seen that the present invention provides a ventable ski hat wherein the open-closure means enables a user to selectively retain or vent body heat from the insulative air layer as required as a means to maintain body heat balance or decrease the discomfort level.

It will be further seen that the present invention provides an insulative, ventable ski hat wherein the vent aperture comprises a mesh fabric layer in inferior adjacency to the open-closure means, which mesh fabric layer and open-closure means together form a selectively-ventable, mesh-filtered vent as a means to prevent matter from entering the insulative air layer. Still further, it will be seen that the present invention provides an insulative, ventable ski hat wherein the open-closure means is defined by a zipper, the zipper comprising a main axis that coincides with the major axis of the substantially elliptical vent aperture. Further still, it will be seen that the present invention provides an insulative, ventable ski hat wherein the insulative, ventable ski hat comprises a superficial fabric layer and a deep fabric layer, the superficial fabric layer comprising an insulative fabric for retaining body heat in adjacency to the superior head surface and the deep fabric layer comprising a moisture-wicking material for conveying perspiration or liquid away from head surfaces. Still further, it will be seen that the present invention provides an insulative, ventable ski hat wherein the major axis of the substantially elliptical vent aperture has a measured dimension ranging from about 5 to 6 inches and wherein the minor axis has a maximum measured dimension of about 1.5 inches so as to provide an aesthetically pleasing yet functional vent aperture. In this last regard, it will be seen that the present invention provides a ventable ski hat constructed from color coordinated materials so as to increase the attractiveness of the hat.

While the above description contains much specificity, this specificity should not be construed as limitations on the scope of the invention, but rather as an exemplification of the invention. For example, it is contemplated that the ventable ski hat need not comprise a mesh fabric layer, a head band member, or even zipper means. The mesh layer is intended to provide a mesh-filtered vent as a means to prevent matter from entering the insulative air layer and is more a matter of convenience to the user rather than necessity. Further the head band member functions to bolster body heat retaining capability. So long as the superior hat member is sufficiently insulative, the head band member is not a matter of necessity. Further, it is contemplated that other open-closure means may function to selectively vent the vent aperture. In this regard, however, it is contemplated that zipper means provide the most efficient means for selectively opening and closing the vent aperture as required.

Accordingly, although the invention has been described by reference to a preferred embodiment and several described methods of manufacture, it is not intended that the novel assembly be limited thereby, but that modifications thereof are intended to be included as falling within the broad scope and spirit of the foregoing disclosure, the following claims and the appended drawings.

I claim:

1. A ventable ski hat for enabling a skier to selectively vent body heat, the ventable ski hat comprising:

a superficial insulative fabric layer, the superficial insulative fabric layer comprising two lateral superficial edges, two lateral superior superficial regions, two intermediate superior superficial regions, two medial superior superficial regions, a superficial fold region, an inferior superficial region, and a superficial layer perimeter, the superficial fold region dividing the superficial insulative fabric layer into substantially identical superficial lateral halves;

a deep moisture-wicking fabric layer, the deep moisture-wicking fabric layer comprising two lateral deep edges, two lateral superior deep regions, two intermediate superior deep regions, two medial superior deep regions, a deep fold region, an inferior deep region, and a deep layer perimeter, the deep fold region dividing the deep moisture-wicking fabric layer into substantially identical deep lateral halves, the deep moisture-wicking fabric layer being positioned in adjacency to the superficial insulative fabric layer, the deep layer perimeter substantially coinciding with the superficial layer perimeter, the deep moisture-wicking fabric layer and the superficial insulative fabric layer being folded about the superior fold region and the deep fold region, the medial superior superficial regions and the medial superior deep regions being stitched to one another in juxtaposed relation to form a closed superior-anterior seam, the lateral superior superficial regions and the lateral superior deep regions being stitched to one another in juxtaposed relation to form a closed superior-posterior seam, the lateral superficial edges and the lateral deep edges being stitched to one another in juxtaposed relation to form a closed posterior seam, the intermediate superior superficial regions and the intermediate superior deep regions thus defining a substantially elliptical superior vent aperture, the vent aperture comprising a major axis, a minor axis, an anterior vent end and a posterior vent end, the vent aperture being medially aligned from the superior-anterior seam to the superior-posterior seam, the inferior superficial region and the inferior deep region thus defining a double layer band-receiving edge;

zipper means, the zipper means comprising an anterior zipper end, a posterior zipper end, laterally extending attachment fabric, and slidable fastener means, the laterally extending attachment fabric being stitched to the intermediate superior superficial regions and the intermediate superior deep regions, the anterior zipper end being adjacent the anterior vent end and the posterior zipper end being adjacent the posterior vent end, the slidable fastener means being intermediate the laterally extending fabric medially aligned from the anterior vent end to the posterior vent end substantially parallel with the major axis, the slidable fastener means for selectively opening and closing the vent aperture;

a mesh fabric layer, the mesh fabric layer comprising an anterior mesh end and a posterior mesh end, the mesh fabric layer being stitched to the intermediate superior superficial regions and the intermediate superior deep regions in adjacency to the zipper means, the anterior mesh end being adjacent the anterior vent end and the posterior mesh end being adjacent the posterior vent end, the mesh fabric layer and the zipper means thus cooperatively forming a selectively ventable, mesh-filtered vent, the mesh-filtered vent being substantially elliptical when in a fully open state; and an insulative head band member, the insulative head band member comprising a superior band attachment edge, an inferior crown-receiving edge, a band fold region, and two lateral band edges, the insulative head band member being folded about the band fold region, the lateral band edges being stitched to one another to form a band seam, the superior band attachment edge being stitched to the band-receiving edge, the band seam being in inferior adjacency to the posterior seam, the inferior crown-receiving end for receiving a skier's head, the skier's head comprising a superior head surface, the mesh fabric layer and zipper means being in spaced relation in superior adjacency to the superior head surface thus defining an insulative air layer, the slidable fastener means thus enabling a skier to selectively vent body heat from the insulative air layer.

2. The ventable ski hat of claim 1 wherein the major axis has a measured dimension ranging from about 5 inches to 6 inches and the minor axis has a maximum measured dimension of about 1.5 inches.

3. The ventable ski hat of claim 2 wherein the mesh fabric layer is substantially taut when the mesh-filtered vent is in a fully open state.

4. The ventable ski hat of claim 3 wherein the superficial insulative fabric layer and the insulative head band member comprise fleece material.

5. The ventable ski hat of claim 4 wherein the superficial insulative fabric layer, the deep moisture-wicking fabric layer, the zipper means, the mesh fabric layer and the insulative head band member each comprise coordinate coloration.

6. A ventable ski hat for enabling a skier to selectively vent body heat, the ventable ski hat comprising:

a superficial fabric layer, the superficial fabric layer comprising two lateral superficial edges, two lateral superior superficial regions, two intermediate superior superficial regions, two medial superior superficial regions, a superficial fold region, an inferior superficial region, and a superficial layer perimeter, the superficial fold region dividing the superficial fabric layer into substantially identical superficial lateral halves;

a deep fabric layer, the deep fabric layer comprising two lateral deep edges, two lateral superior deep regions, two intermediate superior deep regions, two medial superior deep regions, a deep fold region, an inferior deep region, and a deep layer perimeter, the deep fold region dividing the deep fabric layer into substantially identical deep lateral halves, the deep fabric layer being positioned in adjacency to the superficial fabric layer, the deep layer perimeter substantially coinciding with the superficial layer perimeter, the deep fabric layer and the superficial fabric layer being folded about the superior fold region and the deep fold region, the medial superior superficial regions and the medial superior deep regions being stitched to one another in juxtaposed relation to form a closed superior-anterior seam, the lateral superior superficial regions and the lateral superior deep regions being stitched to one another in juxtaposed relation to form a closed superior-posterior seam, the lateral superficial edges and the lateral deep edges being stitched to one another in juxtaposed relation to form a closed posterior seam, the intermediate superior superficial regions and the intermediate superior deep regions thus defining a substantially elliptical superior vent aperture, the vent aperture comprising a major axis, a minor axis, an anterior vent end and a posterior vent end, the vent aperture being medially aligned from the superior-anterior seam to the superior-posterior seam, the inferior superficial region and the inferior deep region thus defining a double layer band-receiving edge;

zipper means, the zipper means comprising an anterior zipper end, a posterior zipper end, laterally extending attachment fabric, and slidable fastener means, the laterally extending attachment fabric being stitched to the intermediate superior superficial regions and the intermediate superior deep regions, the anterior zipper end being adjacent the anterior vent end and the posterior zipper end being adjacent the posterior vent end, the slidable fastener means being intermediate the laterally extending fabric medially aligned from the anterior vent end to the posterior vent end substantially parallel with the major axis, the slidable fastener means for selectively opening and closing the vent aperture, the zipper means thus forming a selectively ventable vent, the vent being substantially elliptical when in a fully open state; and a head band member, the head band member comprising a superior band attachment edge, an inferior crown-receiving edge, a band fold region, and two lateral band edges, the head band member being folded about the band fold region, the lateral band edges being stitched to one another to form a band seam, the superior band attachment edge being stitched to the band-receiving edge, the band seam being in inferior adjacency to the posterior seam, the inferior crown-receiving end for receiving a skier's head, the skier's head comprising a superior head surface, the zipper means being in spaced relation in superior adjacency to the superior head surface thus defining an insulative air layer, the slidable fastener means thus enabling a skier to selectively vent body heat from the insulative air layer.

7. The ventable ski hat of claim 6 wherein the ventable ski hat comprises a mesh fabric layer, the mesh fabric layer comprising an anterior mesh end and a posterior mesh end, the mesh fabric layer being stitched to the intermediate superior superficial regions and the intermediate superior deep regions in adjacency to the zipper means, the anterior mesh end being adjacent the anterior vent end and the posterior mesh end being adjacent the posterior vent end, the mesh fabric layer and the zipper means thus cooperatively forming a selectively ventable, mesh-filtered vent.

8. The ventable ski hat of claim 6 wherein the mesh fabric layer is substantially taut when the mesh-filtered vent is in a fully open state.

9. The ventable ski hat of claim 7 wherein the superficial fabric layer comprises an insulative fabric, the deep fabric layer comprises a moisture-wicking fabric, and the head band member comprises an insulative fabric.

10. The ventable ski hat of claim 8 wherein the major axis has a measured dimension ranging from about 5 inches to 6 inches and the minor axis has a maximum measured dimension of about 1.5 inches.

11. The ventable ski hat of claim 9 wherein the superficial insulative fabric layer and the head band member comprise fleece material.

12. The ventable ski hat of claim 7 wherein the superficial fabric layer, the deep fabric layer, the zipper means, the mesh fabric layer and the head band member each comprise coordinate coloration.

13. A ventable ski hat for enabling a skier to selectively vent body heat, the ventable ski hat comprising:

a superior hat member, the superior hat member comprising two lateral edges, two lateral superior regions, two intermediate superior regions, two medial superior regions, a fold region, and an inferior region, the superior hat member being folded about the fold region, the medial superior regions being stitched to one another in juxtaposed relation to form a closed superior-anterior seam, the lateral superior regions being stitched to one another in juxtaposed relation to form a closed superior-posterior seam, the lateral edges being stitched to one another in juxtaposed relation to form a closed posterior seam, the intermediate superior regions thus defining a vent aperture, the vent aperture comprising a longitudinal axis, a latitudinal axis, an anterior vent end and posterior vent end, the vent aperture being medially aligned from the superior-anterior seam to the superior-posterior seam, the inferior region thus defining a band-receiving edge;

zipper means, the zipper means comprising an anterior zipper end, a posterior zipper end, laterally extending attachment fabric, and slidable fastener means, the laterally extending attachment fabric being stitched to the intermediate superior regions, the anterior zipper end being adjacent the anterior vent end and the posterior zipper end being adjacent the posterior vent end, the slidable fastener means being intermediate the laterally extending fabric medially aligned from the anterior vent end to the posterior vent end substantially parallel with the longitudinal axis, the slidable fastener means for selectively opening and closing the vent aperture, the zipper means thus forming a selectively ventable vent; and a head band member, the head band member comprising a superior band attachment edge, an inferior crown-receiving edge, a band fold region, and two lateral band edges, the head band member being folded about the band fold region, the lateral band edges being stitched to one another to form a band seam, the superior band attachment edge being stitched to the band-receiving edge, the band seam being in inferior adjacency to the posterior seam, the inferior crown-receiving edge for receiving a skier's head, the skier's head comprising a superior head surface, the zipper means being in spaced relation in superior adjacency to the superior head surface thus defining an insulative air layer, the slidable fastener means thus enabling a skier to selectively vent body heat from the insulative air layer.

14. A ventable ski hat of claim 13 wherein the superior hat member comprises a superficial fabric layer and a deep fabric layer.

15. The ventable ski hat of claim 14 wherein the ventable ski hat comprises a mesh fabric layer, the mesh fabric layer comprising an anterior mesh end and a posterior mesh end, the mesh fabric layer being stitched to the intermediate superior regions in adjacency to the zipper means, the anterior mesh end being adjacent the anterior vent end and the posterior mesh end being adjacent the posterior vent end, the mesh fabric layer and the zipper means thus cooperatively forming a selectively ventable, mesh-filtered vent.

16. The ventable ski hat of claim 15 wherein the mesh fabric layer is substantially taut when the mesh-filtered vent is in a fully open state.

17. The ventable ski hat of claim 16 wherein the mesh-filtered vent is substantially elliptical when in a fully open state, the mesh-filtered vent thus comprising a major axis and minor axis, the major axis coinciding with the longitudinal axis, the minor axis coinciding with the latitudinal axis.

18. The ventable ski hat of claim 14 wherein the superficial fabric layer comprises an insulative fabric, the deep fabric layer comprises a moisture-wicking fabric, and the head band member comprises an insulative fabric.

19. The ventable ski hat of claim 17 wherein the major axis has a measured dimension ranging from about 5 inches to 6 inches and the minor axis has a maximum measured dimension of about 1.5 inches.

20. The ventable ski hat of claim 13 wherein the superficial fabric layer and the head band member comprise fleece material.

21. The ventable ski hat of claim 15 wherein the superficial fabric layer, the deep fabric layer, the zipper means, the mesh fabric layer and the head band member each comprise coordinate coloration.

22. A ventable hat for enabling a wearer to selectively vent body heat, the ventable hat comprising:

a hat member, the hat member comprising two lateral edges, two lateral superior regions, two intermediate superior regions, two medial superior regions, a fold region, and an inferior region, the hat member being folded about the fold region, the medial superior regions being stitched to one another in juxtaposed relation to form a closed superior-anterior seam, the lateral superior regions being stitched to one another in juxtaposed relation to form a closed superior-posterior seam, the lateral edges being stitched to one another in juxtaposed relation to form a closed posterior seam, the intermediate superior regions thus defining a vent aperture, the vent aperture comprising a longitudinal axis, a latitudinal axis, an anterior vent end and posterior vent end, the vent aperture being medially aligned from the superior-anterior seam to the superior-posterior seam, the inferior region thus defining a crown-receiving edge; and zipper means, the zipper means comprising an anterior zipper end, a posterior zipper end, laterally extending attachment fabric, and slidable fastener means, the laterally extending attachment fabric being stitched to the intermediate superior regions, the anterior zipper end being adjacent the anterior vent end and the posterior zipper end being adjacent the posterior vent end, the slidable fastener means being intermediate the laterally extending fabric medially aligned from the anterior vent end to the posterior vent end substantially parallel with the longitudinal axis, the slidable fastener means for selectively opening and closing the vent aperture, the zipper means thus forming a selectively ventable vent, the inferior crown-receiving end for receiving a wearer's head, the wearer's head comprising a superior head surface, the zipper means being in spaced relation in superior adjacency to the superior head surface thus defining an insulative air layer, the slidable fastener means thus enabling a skier to selectively vent body heat from the insulative air layer.

23. The ventable hat of claim 22 wherein the hat member comprises a superficial fabric layer and a deep fabric layer.

24. The ventable hat of claim 23 wherein the superficial fabric layer comprises an insulative fabric layer and the deep fabric layer comprises a moisture-wicking fabric.

25. A ventable hat for enabling a user to selectively vent body heat, the ventable hat comprising:

a superior vent portion and an inferior crown-receiving portion, the vent portion comprising an anterior-superior portion, a posterior-superior portion and a selectively-veritable vent aperture, the vent aperture extending intermediate the anterior-superior portion and the posterior-superior portion, the vent aperture comprising open-closure means, a major axis and a minor axis, the major axis being longitudinally and medially aligned from the anterior-superior portion to the posterior-superior portion, the vent aperture being positionable in unobstructed spaced relation in superior adjacency to a user's superior head surface, the vent aperture for forming a continuous, insulative air layer intermediate the user's superior head surface and the open-closure means, the open-closure means for enabling the user to selectively vent body heat from the continuous, insulative air layer.

26. The ventable hat of claim 25 wherein the vent aperture comprises a mesh fabric layer, the mesh fabric layer and the open-closure means thus forming a selectively-ventable, mesh-filtered vent.

27. The ventable hat of claim 25 wherein the open-closure means is defined by a zipper, the zipper having a main axis, the main axis coinciding with the major axis.

28. The ventable hat of claim 25 wherein the vent aperture is substantially elliptical when in a fully open state.

29. The ventable hat of claim 25 wherein the ventable hat comprises a superficial fabric layer and a deep fabric layer, the superficial fabric layer comprising an insulative fabric material, the deep fabric layer comprising a moisture-wicking fabric material.

30. The ventable hat of claim 25 wherein the major axis has a measured dimension ranging from about 5 inches to 6 inches and the minor axis has a maximum measured dimension of about 1.5 inches.

31. A method of manufacturing a ventable ski hat, the method of manufacture comprising the steps of:

providing a superficial insulative fabric layer, a deep moisture-wicking fabric layer, a mesh fabric layer, and zipper means, the zipper means comprising laterally extending attachment fabric and slidable fastener means;

cutting a superficial insulative fabric layer pattern from the superficial insulative fabric layer, the superficial insulative fabric layer pattern comprising two lateral superficial edges, two lateral superior superficial regions, two intermediate superior superficial regions, two medial superior superficial regions, a superficial fold region, an inferior superficial region, a superficial layer superior perimeter, and a superficial layer inferior perimeter, the superficial fold region dividing the superficial insulative fabric layer pattern into substantially identical superficial lateral halves;

cutting a deep moisture-wicking fabric layer pattern from the deep moisture-wicking fabric layer, the deep moisture-wicking fabric layer comprising two lateral deep edges, two lateral superior deep regions, two intermediate superior deep regions, two medial superior deep regions, a deep fold region, an inferior deep region, a deep layer superior perimeter and a deep layer inferior perimeter, the deep fold region dividing the deep moisture-wicking fabric layer pattern into substantially identical deep lateral halves;

cutting an insulative head band member pattern from the superficial insulative fabric layer, the insulative head band member pattern comprising a superior band attachment edge, an inferior crown-receiving edge, and two lateral band edges;

cutting a mesh fabric layer pattern from the mesh fabric layer, the mesh fabric layer pattern comprising an anterior mesh end and a posterior mesh end;

positioning the deep moisture-wicking fabric layer in superior adjacency to the superficial insulative fabric layer, the deep layer perimeter substantially coinciding with the superficial layer perimeter, the a superficial fold region coinciding with the deep fold region;

folding the deep moisture-wicking fabric layer pattern and the superficial insulative fabric layer pattern about the superior fold region and the deep fold region, the superficial insulative fabric layer pattern being deep to the deep moisture-wicking fabric layer pattern;

marking a zipper location, the zipper location being located at the two intermediate superior superficial regions and the two intermediate superior deep regions;

stitching the medial superior superficial regions and the medial superior deep regions to one another in juxtaposed relation to form a closed superior-anterior seam;

stitching the lateral superior superficial regions and the lateral superior deep regions to one another in juxtaposed relation to form a closed superior-posterior seam;

stitching the lateral superficial edges and the lateral deep edges to one another in juxtaposed relation to form a closed posterior seam;

backstitching the zipper location;

stitching the laterally extending attachment fabric to the intermediate superior superficial regions and the intermediate superior deep regions to form a zipper attachment seam;

stitching the mesh fabric layer pattern to the intermediate superior superficial regions and the intermediate deep regions in adjacency to the zipper means to form a mesh attachment seam;

stitching the lateral band edges to one another to form a posterior band seam; and stitching the superior band attachment edge to the band-receiving edge to form a superior band seam, the posterior band seam being in inferior adjacency to the posterior seam.

32. The method of manufacturing a ventable ski hat of claim 31 wherein the method comprises an additional step after positioning the deep moisture-wicking fabric layer pattern in superior adjacency to the superficial insulative fabric layer pattern, the additional step comprising the step of pinning the deep moisture-wicking fabric layer pattern to the superficial insulative fabric layer pattern.

33. The method of manufacturing a ventable ski hat of claim 32 wherein the method comprises an additional step after backstitching the zipper location, the additional step comprising the step of pinning the laterally extending attachment fabric to the intermediate superior superficial regions and the intermediate superior deep regions.

34. The method of manufacturing a ventable ski hat of claim 33 wherein the method comprises an additional step after stitching the laterally extending attachment fabric to the intermediate superior superficial regions and the intermediate superior deep regions, the additional step comprising the step of pinning the mesh fabric layer pattern to the intermediate superior superficial regions and the intermediate deep regions.

35. The method of manufacturing a ventable ski hat of claim 34 wherein the method comprises an additional step after stitching the lateral band edges to one another, the additional step comprising the step of pinning the superior band attachment edge to the band-receiving edge.

36. The method of manufacturing a ventable ski hat of claim 31 wherein the method comprises additional steps after stitching the laterally extending attachment fabric to the intermediate superior superficial regions and the intermediate superior deep regions, the additional steps comprising the steps of:

adjusting the deep moisture-wicking fabric layer pattern and the superficial insulative fabric layer pattern, the deep moisture-wicking fabric layer pattern being deep to the superficial insulative fabric layer pattern;

top-stitching the intermediate superior superficial regions and the intermediate superior deep regions to form a rectangle pattern, the rectangle pattern enveloping the slidable fastener means; and adjusting the deep moisture-wicking fabric layer pattern and the superficial insulative fabric layer pattern, the superficial insulative fabric layer pattern being deep to the deep moisture-wicking fabric layer pattern.

37. The method of manufacturing a ventable ski hat of claim 31 wherein the method comprises an additional step after stitching the superior band attachment edge to the band-receiving edge, the additional step comprising the step of surge stitching the superior-posterior seam, the superior-anterior seam, the posterior seam, the mesh attachment seam, the superior band seam, and the posterior band seam.

38. A method of manufacturing a ventable hat, the method of manufacture comprising the steps of:

providing a hat member fabric pattern and zipper means, the zipper means comprising laterally extending attachment fabric, and slidable fastener means;

cutting a hat member pattern from the hat member fabric pattern, the hat member pattern comprising two lateral edges, two lateral superior regions, two intermediate superior regions, two medial superior regions, a fold region, and an inferior region, the fold region dividing the hat member pattern into substantially identical lateral halves;

folding the hat member pattern about the fold region;

stitching the medial superior regions to one another in juxtaposed relation to form a closed superior-anterior seam;

stitching the lateral superior regions to one another in juxtaposed relation to form a closed superior-posterior seam;

stitching the lateral edges to one another in juxtaposed relation to form a closed posterior seam; and installing open-closure means at the intermediate superior regions.

39. The method of manufacturing a ventable hat of claim 38 wherein the step of installing open-closure means at the intermediate superior regions is defined by stitching the laterally extending attachment fabric to the intermediate superior regions to form a zipper attachment seam.

40. The method of manufacturing a ventable hat of claim 39 wherein the method comprises an additional step after providing a hat member fabric pattern and zipper means, the additional step comprising the step of cutting a head band pattern from the hat member fabric pattern, the head band pattern comprising a superior band attachment edge, an inferior crown-receiving edge, and two lateral band edges.

41. The method of manufacturing a ventable hat of claim 40 wherein the method comprises an additional step after stitching the laterally extending attachment fabric to the intermediate superior regions, the method comprising the additional step of stitching the lateral band edges to one another to form a posterior band seam.

42. The method of manufacturing a ventable hat of claim 41 wherein the method comprises an additional step after stitching the lateral band edges to one another to form a posterior band seam, the method comprising the step of stitching the superior band attachment edge to the inferior edge to form a superior band seam, the posterior band seam being in inferior adjacency to the posterior seam.

43. The method of manufacturing a ventable hat of claim 39 wherein the method comprises an additional step after folding the hat member pattern about the fold region, the additional step comprising the step of marking a zipper location, the zipper location being located at the two intermediate superior regions.

44. The method of manufacturing a ventable hat of claim 39 wherein the method of manufacture comprises an additional step after stitching the lateral edges to one another, the additional step comprising the step of backstitching the zipper location.

45. The method of manufacturing a ventable hat of claim 42 wherein the method of manufacture comprises an additional step after stitching the superior band attachment edge to the inferior edge to form a superior band seam, the additional step comprising the step of surge stitching at least one hat seam, the hat seam being chosen from the group consisting of the superior-posterior seam, the superior-anterior seam, the posterior seam, the superior band seam, and the posterior band seam.

46. A ventable hat for enabling a user to selectively vent body heat, the ventable hat comprising:

a superior vent portion, an inferior crown-receiving portion, a superficial fabric layer, and a deep fabric layer, the superficial fabric layer comprising an insulative fabric material, tho deep fabric layer comprising a moisture-wicking fabric material, the vent portion comprising an anterior-superior portion, a posterior-superior portion and a selectively-ventable vent aperture, the vent aperture extending intermediate the anterior-superior portion and the posterior-superior portion, the vent aperture comprising open-closure means, a major axis and a minor axis, the major axis being medially aligned along a user's head, the user's bead comprising a superior head surface, the open-closure means being in spaced relation in superior adjacency to the superior head surface thus defining an insulative air layer intermediate the user's superior bead surface and the open-closure means, the open-closure means for enabling the user to selectively vent body heat from the insulative air layer.

* * * * *